US007908813B2

(12) United States Patent
Gulbrandsen et al.

(10) Patent No.: US 7,908,813 B2
(45) Date of Patent: Mar. 22, 2011

(54) CEILING PANEL

(75) Inventors: Peder J. Gulbrandsen, Aurora, IL (US); Alan C. Wendt, Inverness, IL (US)

(73) Assignee: USG Interiors, Inc., Chicago, IL (US)

( * ) Notice: Subject to any disclaimer, the term of this patent is extended or adjusted under 35 U.S.C. 154(b) by 0 days.

(21) Appl. No.: 12/821,205

(22) Filed: Jun. 23, 2010

(65) Prior Publication Data

US 2010/0269444 A1 Oct. 28, 2010

Related U.S. Application Data

(63) Continuation of application No. 11/970,767, filed on Jan. 8, 2008, now Pat. No. 7,765,762.

(51) Int. Cl.
*E04B 9/24* (2006.01)

(52) U.S. Cl. ..... 52/506.09; 52/506.07; 52/506.08; 52/586.2

(58) Field of Classification Search ..... 52/506.07, 52/506.08, 506.09, 783.1, 795.1, 580, 582.1, 52/586.1, 586.2
See application file for complete search history.

(56) References Cited

U.S. PATENT DOCUMENTS

| | | | |
|---|---|---|---|
| 3,021,915 | A | 2/1962 | Kemp |
| 3,232,395 | A | 2/1966 | LaBarge |
| 3,277,622 | A | 10/1966 | Svend |
| 3,286,426 | A | 11/1966 | Halbostad et al. |
| 3,461,630 | A | 8/1969 | Lovullo |
| 3,488,908 | A | 1/1970 | Jahn |
| 3,513,613 | A | 5/1970 | Reid et al. |
| 3,581,453 | A | 6/1971 | Jones et al. |
| 3,640,042 | A | 2/1972 | Kidney |
| 4,026,081 | A | 5/1977 | Delaney et al. |
| 4,291,783 | A | 9/1981 | Harris |
| 4,297,822 | A | 11/1981 | Rijnders |
| 4,428,454 | A | 1/1984 | Capaul et al. |
| 4,640,064 | A | 2/1987 | Goodworth, II |
| 4,696,141 | A | 9/1987 | Nassof |
| 4,730,428 | A | 3/1988 | Head et al. |
| 4,736,564 | A | 4/1988 | Gailey |
| 4,760,677 | A | 8/1988 | Nassof |
| 5,024,034 | A | 6/1991 | Gailey |
| 5,115,616 | A | 5/1992 | Nixon |
| 5,182,893 | A | 2/1993 | Goodworth |
| 5,311,719 | A | 5/1994 | Jahn |
| 5,507,125 | A | 4/1996 | McClure |
| 5,533,312 | A | 7/1996 | Mihalcheon |
| 5,692,345 | A | 12/1997 | Mogaki et al. |

(Continued)

FOREIGN PATENT DOCUMENTS

| | | | |
|---|---|---|---|
| EP | 13852 | A1 | 8/1980 |

(Continued)

*Primary Examiner* — Brian E Glessner
*Assistant Examiner* — James J Buckle, Jr.
(74) *Attorney, Agent, or Firm* — Pearne & Gordon LLP

(57) ABSTRACT

A ceiling panel is provided for use in a grid-type suspended ceiling, wherein the grid includes a plurality of spaced grid runners. The ceiling panel comprises a tile base with perimeter segments and perimeter profiles along at least a portion of at least two of the perimeter segments. Each profile is supportable by the grid runners during suspension. A facing material is secured across the perimeter segments, and extends beyond the perimeter profiles in order to at least partially conceal two of the grid runners when the tile is suspended from the two grid runners and viewed from below.

1 Claim, 22 Drawing Sheets

U.S. PATENT DOCUMENTS

| | | | | |
|---|---|---|---|---|
| 6,108,994 | A | 8/2000 | Bodine | |
| 6,230,463 | B1 | 5/2001 | Bodine | |
| 6,260,325 | B1 | 7/2001 | Wendt | |
| 6,389,771 | B1 | 5/2002 | Moller | |
| 6,467,228 | B1 | 10/2002 | Wendt et al. | |
| 6,513,295 | B2 | 2/2003 | Bernardino | |
| 7,536,836 | B2 | 5/2009 | Moser Rossel | |
| 2001/0052212 | A1 | 12/2001 | Bernardino | |
| 2002/0096243 | A1 | 7/2002 | Harrison | |
| 2003/0182894 | A1 * | 10/2003 | Galsgaard et al. | 52/747.1 |
| 2005/0211500 | A1 | 9/2005 | Wendt et al. | |
| 2006/0162283 | A1 | 7/2006 | Moser Rossel | |
| 2006/0218871 | A1 | 10/2006 | Wendt et al. | |
| 2009/0042010 | A1 | 2/2009 | Stanhope | |
| 2009/0173030 | A1 | 7/2009 | Gulbrandsen | |
| 2009/0188195 | A1 | 7/2009 | McGee et al. | |

FOREIGN PATENT DOCUMENTS

| | | | |
|---|---|---|---|
| EP | 211172 | A2 | 2/1987 |
| EP | 468755 | A1 * | 1/1992 |
| GB | 2200151 | A | 7/1988 |
| JP | 04030064 | A | 2/1992 |

* cited by examiner

CEILING PANEL

TECHNICAL FIELD

This invention relates generally to suspended ceiling systems and, more particularly, to panels used in a suspended ceiling system.

BACKGROUND

Suspended ceiling systems are widely used in a variety of applications, such as in commercial and residential buildings. Grid-type suspension ceilings cover the plenum area, while still allowing access to the plenum area, which typically contains components of the building's wiring, heating, venting, air conditioning, plumbing, among other mechanical components. A grid of spaced runners and cross-runners are frequently used to position and support the panels. The runners and cross-runners are generally suspended from the ceiling using wires, rods, or other suspension runners, and are arranged and sized according to the shape and size of the panels being supported therein.

The ceiling tile or panel is commonly supported in the grid by laying the perimeter of the panel on the panel-support flanges of the runners. This results in an exposed suspension grid system, which must be, among other requirements, finished and otherwise made aesthetically pleasing. Thus, by decreasing the exposed portion of the grid, manufacturing costs may be reduced by avoiding the finishing requirements. In addition, if grid exposure is decreased by positioning a portion of the panel to cover the grid, as opposed to using additional structures such as framing or molding, the desired monolithic appearance of a ceiling grid may be achieved.

While it is often preferable that at least a portion of the grid runners be concealed to provide a more aesthetically pleasing ceiling, installation and removal of the ceiling panels within the grid can be complicated by the features used to conceal the grid. For example, additional trim pieces can be added to the grid to provide an aesthetically pleasing transition from panel to panel. This, however, adds additional costs by way of adding more components and installation time. In addition, the trim pieces may interfere with easy installation of the panel.

Another known installation and removal method is a lift-and-shift installation, wherein one edge of the ceiling panel is lifted and mounted onto a grid runner and then the edge is shifted toward the first grid runner to allow the opposite edge of the panel, including any concealment features, to give clearance so that the opposite edge can be mounted onto a second grid runner and then shifted and centered. This design enables the panel to include structure that extends beyond the grid to conceal the grid. The lift-and-shift installation reduces the amount of space needed above the grid and makes installation faster since the installer can more easily raise and manipulate the ceiling panel into position without raising the panel through and above the grid.

As with most construction, quicker and easier installation saves both time and money. Thus, the ceiling panels and the method of installation should be efficient, economical, and effective. Further, since access is required to the plenum area above the suspension ceiling, the panels should be readily removable.

DETAILED DESCRIPTION OF THE PREFERRED EMBODIMENTS

Generally, in one form, a ceiling panel is provided for use in a grid-type suspended ceiling, wherein the grid includes a plurality of spaced grid runners. The ceiling panel comprises a tile base with perimeter segments and perimeter profiles along at least a portion of at least two of the perimeter segments. Each profile is supportable by the grid runners during suspension. A facing material is secured across the perimeter segments, and extends beyond the perimeter profiles in order to at least partially conceal two of the grid runners when the tile is suspended from the two grid runners and viewed from below.

Figure 1:
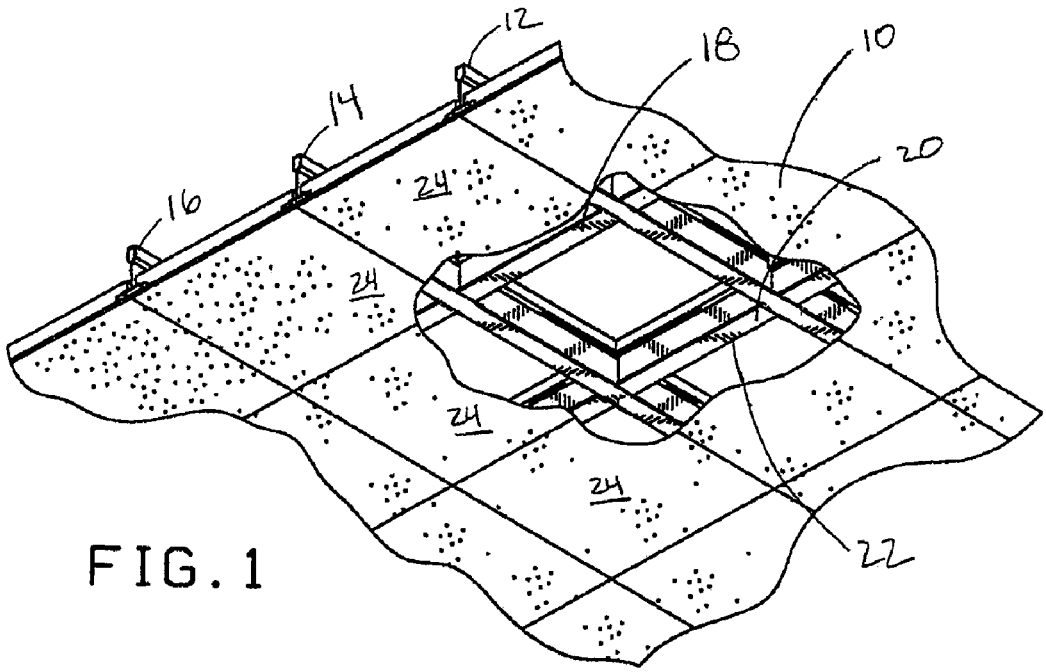
FIG. 1 is a perspective view of a suspended ceiling system as configured in accordance with various embodiments of the invention.

More specifically, and with reference to FIG. 1, a suspended ceiling is depicted generally at 10, and includes a plurality of main tee grid runners 12, 14, 16 and a plurality of cross tee grid runners 18, 20 connected to the main tee grid runners 12, 14, 16 to form a grid structure 22. The main tee grid runners 12, 14, 16, are typically hung from a ceiling structure (not shown), such as, for example, joists or a slab ceiling. The main tee grid runners 12, 14, 16 are hung from the ceiling structure by suspension members (not shown), such as wires or rods.

The main tee grid runners 12, 14, 16 are generally available in standard lengths, such as 12 feet (3.66 meters), and multiple main tee grid runners may be spliced together to run the length of a room. The main tee grid runners 12, 14, 16 and cross tee grid runners 18, 20 are configured and positioned according to the size and shape of the panel to be positioned within the grid. As shown in FIG. 1, the panels 24 are generally rectangular in shape and, therefore, the main tee grid runners 12, 14, 16 are generally oriented parallel and spaced apart from each other. The cross tee grid runners 18, 20 are also generally oriented parallel and spaced apart from each other, while extending generally perpendicular to the main tee grid runners 12, 14, 16 to form the grid 22. Once the grid 22 is formed, the ceiling panels 24, such as those described below, are placed into spaces formed by the grid 22 and suspended by the grid structure 22. The ceiling panels 24 are generally suspended in a horizontal plane, although other configurations are possible. It should be noted that the grid 22 of FIG. 1, including the configuration and orientation of the main tee grid runners 12, 14, 16 and cross tee grid runners 18, 20, is merely illustrative and other configurations are contemplated to accommodate ceiling panels of different shapes and sizes.

Figure 2:
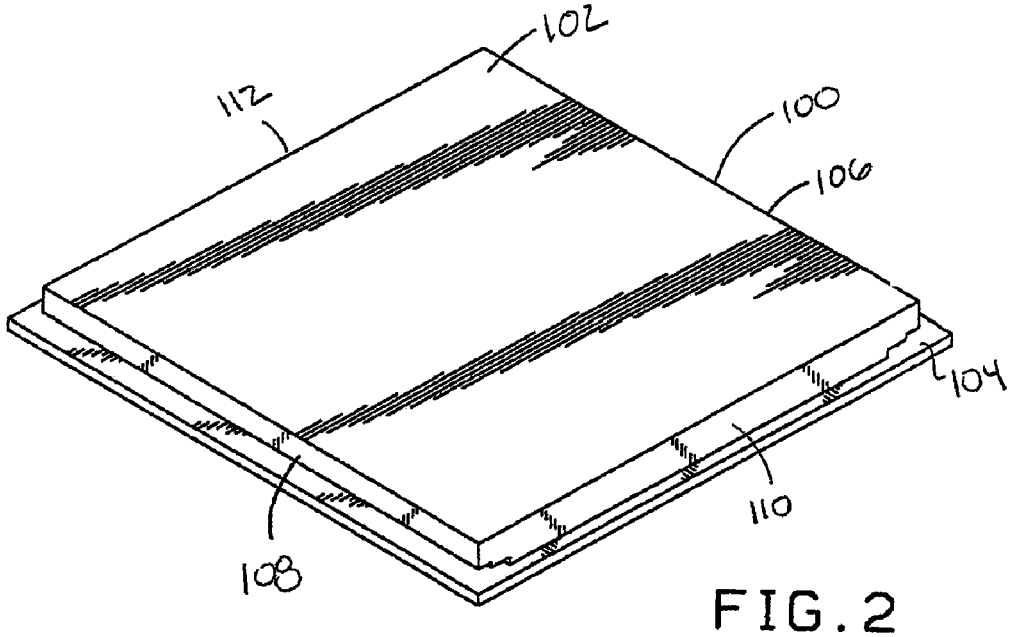
FIG. 2 is a perspective view of a first embodiment of a ceiling panel embodying features of the present invention.

With reference to FIG. 2, there is illustrated a perspective view of a first embodiment of a ceiling panel 100 to be used in the grid structure 22 of FIG. 1. In this embodiment, the ceiling panel 100 comprises a core tile or tile base 102 and a lightweight facing material 104 secured across a lower face 126 (shown in FIG. 4) of the tile base 102. Both the tile base 102 and the facing material 104 are shown as being generally rectangular in shape, although other shapes are contemplated. The facing material 104 generally functions to provide an aesthetically pleasing and monolithic ceiling appearance. The tile base 102 provides the suspension structure for the ceiling panel 100 such that the ceiling panel 100 engages with and is supported by the grid 22. The tile base 102 can have a variety of materials known in the art, such as, for example, fiberglass, mineral fiber, plastic, wood, or metal. The tile base 102 is preferably lightweight in order to minimize the overall weight of the ceiling panel 100.

Figure 3:
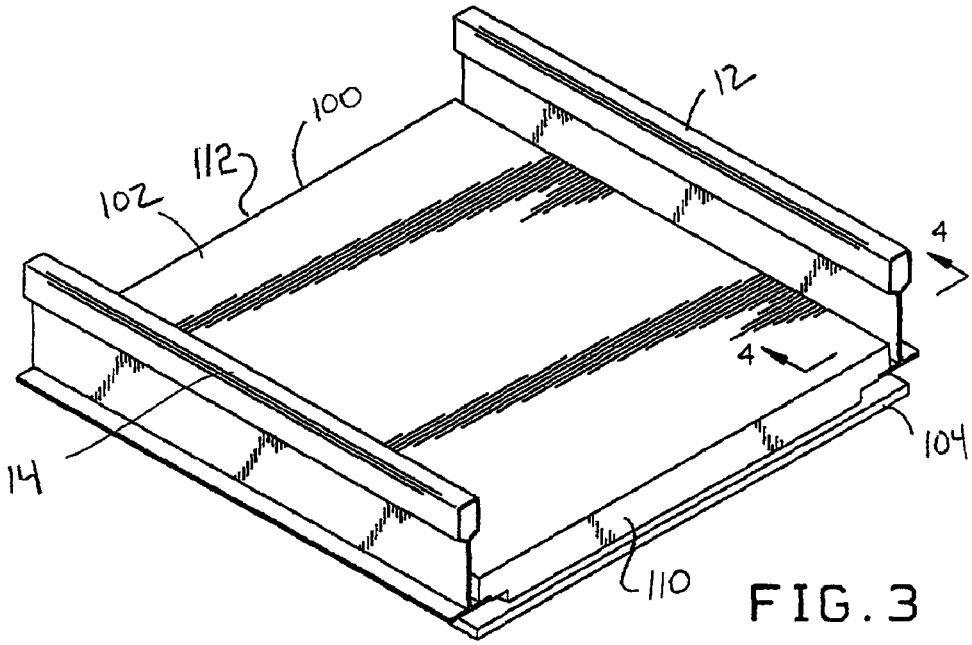
FIG. 3 is a perspective view of the ceiling panel of FIG. 2 as suspended from grid runners.
Figure 4:
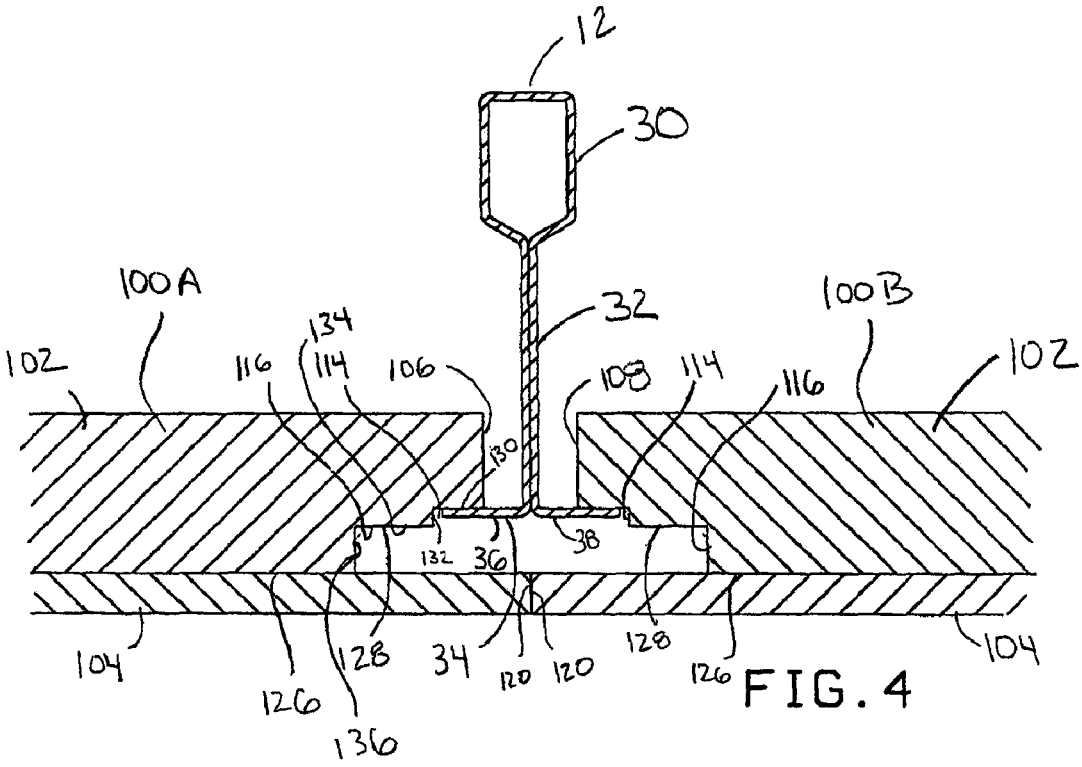
FIG. 4 is a cross-sectional view of the ceiling panel and grid runner of FIG. 3 as taken along line 4-4 thereof, with an adjacent ceiling panel suspended from the grid runner.

As illustrated in FIG. 4, each main tee 12, 14, 16 has a generally identical configuration, with such configuration being generally known in the art. The cross-section of each main tee 12, 14, 16 includes an upper bulb 30, a web 32 extending from the bulb 30, and a support flange 34, having laterally extending sides 36 and 38. The ceiling panels 100 are generally supported or engaged with the sides 36, 38 of the support flange 34 to maintain the ceiling panels 100 in a suspended position within the grid 22. FIGS. 3 and 4 show the installed condition of the ceiling panel 100.

As seen in FIGS. 2-5, the tile base 102 has perimeter segments 106, 108, 110, and 112 and a stepped perimeter profile 128 along at least two opposing perimeter segments or edge regions 106, 108. In this embodiment, the stepped profile 128 is comprised of a horizontal support kerf 114 formed approximately halfway down edge regions 106, 108 of the tile base 102 and is defined by an upper horizontal surface 130 and an end vertical surface 132. A positioning kerf 116 is formed below the support kerf 114 along the edge regions 106, 108, with the positioning kerf 116 defined by an upper horizontal surface 134 and an end vertical surface 136 and the positioning kerf 116 extending horizontally deeper than the support kerf 114 to complete the stepped profile 128. The support kerf 114 generally functions to provide a suspension surface for the ceiling panel 100, with the support kerf 114 being supported by the flange 34 of the main tee grid runner 12 during suspension of the ceiling panel 100, as shown in FIGS. 3 and 4. The support kerf 114 also assists in accurately positioning the ceiling panel 100 on the grid flange 34. As shown, the support kerf 114 has a height slightly greater than the height of the flange 34 of the main the grid runner 12 and extends deep enough to allow the support kerf 114 to be supported with stability by the flange 34. The positioning kerf 116 allows for the lift and shift installation and/or removal of the ceiling panel 100 from the grid 22. The height of the positioning kerf 116 is preferably greater than the thickness of the facing material 104 to provide for sufficient clearance for the installation and removal of the ceiling panel 100. In other words, the facing material 104 has a thickness less than a distance between perimeter profile 128 and the facing material 104 so that the facing material 104 from an adjacent ceiling panel can fit within this space as described below. The tile base 102 should be generally thick enough to accommodate the stepped profile 128. Another pair of opposing perimeter segments or side regions 110, 112 of the ceiling panel 100 are shown on FIG. 2 as vertically extending linear walls, although other profile options may be used. From the foregoing and with reference to FIGS. 2-5, it will be understood that the facing material 104 is secured to the lower face of the base 102, the positioning kerf 116 has an upper surface and a lower surface whereby the facing material forms the lower surface of the positioning kerf and the facing material is cantilevered beyond each of the four sides of the base.

The facing material 104 is preferably a thin, lightweight scrim. The lightweight nature of the facing material 104 allows for alternate suspension and installation methods. The facing material 104 may be any of a variety of materials known in the art, such as, for example, woven or non-woven material, wood, fiber, plastic, polymer, metal, foam, foil, film, ceramic, glass, or any combination thereof. In addition, the facing material 104 properties may be varied by treating the material, such as, for example, by coating, forming, thermosetting, or layering the material to enhance or modify structural or performance capabilities or appearance. The material and/or treatment of the material may be selected based on any of a variety of targeted properties for the facing material 104, such as, for example, the weight, rigidity, structural integrity, noise-reduction coefficient characteristics, sound transmission coefficient characteristics, fire resistance, acoustical performance, aesthetics, humidity and moisture resistance, and microbial resistance, just to name a few. The facing material 104 may be rigid, semi-rigid, or flexible, depending on the properties and thickness of the material that is used. For the present embodiment, the facing material is preferably thick enough to provide some structure and rigidity to the facing material. By one optional approach, the material of the tile base 102 and the facing material 104 may be selected and coordinated to acquire desired aesthetics and acoustical properties.

The facing material 104 may be secured to the tile base 102 by any method known in the art, such as, for example, by adhering or laminating the layers together or by a mechanical connection between the layers. The facing material 104 is sized to extend beyond an edge region of the tile base 102. As shown in FIGS. 2-5, the facing material 104 is secured across the perimeter segments 106-112, and preferably extends beyond the tile base 102 around the entire perimeter of the core tile 104. As a result, the facing material 104 conceals the stepped profile 128 of the opposing edge regions 106, 108 of the tile base 102 during suspension when viewed from below, thereby at least partially concealing two of the grid runners and the ceiling panel's point of engagement and support with the grid 22.

In this embodiment, the facing material 104 extends beyond the edge region of the core tile to at least partially conceal the grid during suspension when viewed from below. Referring to FIG. 3, when the support kerf 114 on opposing sides of the tile base 102 are supported by adjacent parallel main tee grid runners 12, 14 such that the ceiling panel 100 is suspended, the facing material 104 extends to conceal the stepped profile 128 and then extends beyond the edge region of the tile base 102 and below the flange 34 such that at least a portion of the grid 22 is concealed. It also should be appreciated that the facing material 104 extends beyond opposing side regions 110, 112 of the tile base 102 to at least partially conceal the cross tee grid runners extending between the main tee grid runners.

Referring now to FIG. 4, adjacent ceiling panels are shown being supported by a common main tee grid runner 12, with the support kerf 114 of edge region 106 of panel 100A being supported by side 36 of the flange 34 and the support kerf 114 of edge region 108 of panel 100B being supported by the other side 38 of the flange 34. In this embodiment, when adjacent panels 100A and 100B are suspended from each side 36, 38 of the grid flange 34, the facing material 104 of each ceiling panel 100A, 100B extends beyond the edge regions 106, 108 of the respective tile bases 102 to at least partially conceal the respective sides 36, 38 of the grid flange 34. In addition, the facing material 104 of each ceiling panel extends beyond the side regions 110, 112 of the respective tile bases 102 to at least partially conceal the cross tee grid runners. Preferably, a portion of the facing material 104 of one ceiling panel 100A contacts a portion of the facing material 104 of the adjacent ceiling panel 100B to conceal a portion of one of the grid runners 12. More specifically, the outer edge regions 120 of the adjacent facing materials 104 of ceiling panels 100A and 100B extend to touch and seat flush against each other such that the main tee grid runners and cross tee grid runners are fully concealed to provide a monolithic suspended ceiling appearance. As can be seen, the length of the facing material 104 beyond the tile base 102 edge regions 106, 108 and side regions 110, 112 is generally a function of the depth of the support kerf 114, the width of the flange 34 of the main tee grid runner 12, and the size of the portion of the flange 34 that is to be concealed.

Figure 5:
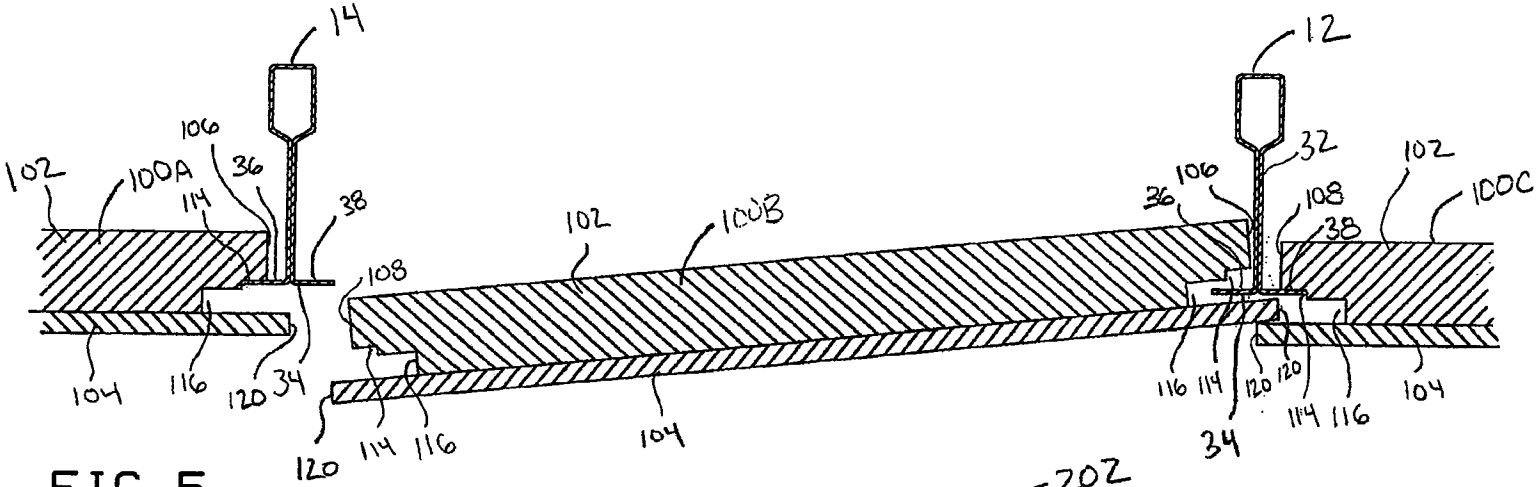
FIG. 5 is a cross-sectional view of a plurality of the suspended ceiling panels and grid runners shown in FIG. 4, showing the installation or removal of one of the ceiling panels.

FIG. 5 illustrates a ceiling panel 100 being installed and/or removed from a suspended position within the grid 22 using a lift-and-shift motion. The removal of the ceiling panel 100 will be described, with the installation of the ceiling panel 100 being accomplished by the same series of steps being performed in reverse order and in the reverse direction. FIG. 5 shows adjacent parallel main tee grid runners 12, 14 with a series of three adjacent ceiling panels 100A, 100B, and 100C. Ceiling panels 100A and 100B share common main tee grid runner 14, and ceiling panels 100B and 100C share common main tee grid runner 12. In this illustration, ceiling panel 100B is being removed. As the ceiling panels are symmetrical in that there is the stepped profile 128 along opposing edge regions 106, 108, it is understood that the installation and/or removal may be performed using the features along either edge region 106, 108 of the ceiling panel 100.

To begin removal, the ceiling panel 100B of this embodiment is lifted vertically until the facing material 104 along sides 106, 108 is generally adjacent the flanges 34 of main tee grid runners 12, 14 and positioned above the facing material 104 of adjacent ceiling panels 100A and 100C. The ceiling panel 100B is then shifted to the right toward ceiling panel 100C (although the removal may also be completed by shifting the ceiling panel 100B to the left toward ceiling panel 100A). When the ceiling panel 100B is shifted to the right, the facing material 104 on side 106 of the ceiling panel 100B is inserted in the space between flange 34 of main tee grid runner 12 and the facing material of ceiling panel 100C. In addition, side 36 of the main tee grid runner 12 is positioned within the positioning kerf 116 of side 106 of the ceiling panel 100B. As the ceiling panel 100B is further shifted to the right, the tile base 102 shifts clear of the flange 34 of main tee grid runner 14 and is able to drop down. As the side 108 of the ceiling panel 100B continues to drop, the facing material 104 of side 106 is removed from the space between the flange 34 of main tee grid runner 12 and the facing material 104 of ceiling panel 100C and also is free to drop down such that panel 100B can be removed.

Referring now to FIGS. 6-9, there is illustrated a second embodiment of a ceiling panel 200 to be used in the grid structure 22 of FIG. 1. As with ceiling panel 100, the ceiling panel 200 of this embodiment comprises a core tile or tile base 202 and a facing material 204 secured across a lower face 226 of the tile base 202 as indicated on FIG. 8. The tile base 202 has generally the same configuration as the tile base 102 of ceiling panel 100, including a stepped perimeter profile along a pair of opposing edge regions 206, 208 and vertically extending linear walls along a pair of opposing side regions 210, 212. The stepped perimeter profile 228 is comprised of a horizontal support kerf 214 and a horizontal positioning kerf 216 positioned below the support kerf 214, with each kerf 214, 216 configured similarly to the kerfs 114, 116 of ceiling panel 100.

The facing material 204 of the ceiling panel 200 has a first pair of opposing outer edge regions 220 adjacent the stepped profile 228 edge regions 206, 208 of the tile base 202 and a second pair of opposing outer edge regions 222 adjacent the side regions 210, 212 of the core tile. As with the facing material 104 of the ceiling panel 100, the facing material 204 is sized to extend beyond an edge region of the lower face 226 of the tile base 202. The facing material 204 preferably extends beyond the tile base 202 around the entire perimeter of the tile base 202. The facing material 204 conceals the stepped profile 228 of the opposing edge regions 206, 208 of the core panel 202 during suspension when viewed from below, in addition to at least partially concealing the grid 22 during suspension.

Figure 6:
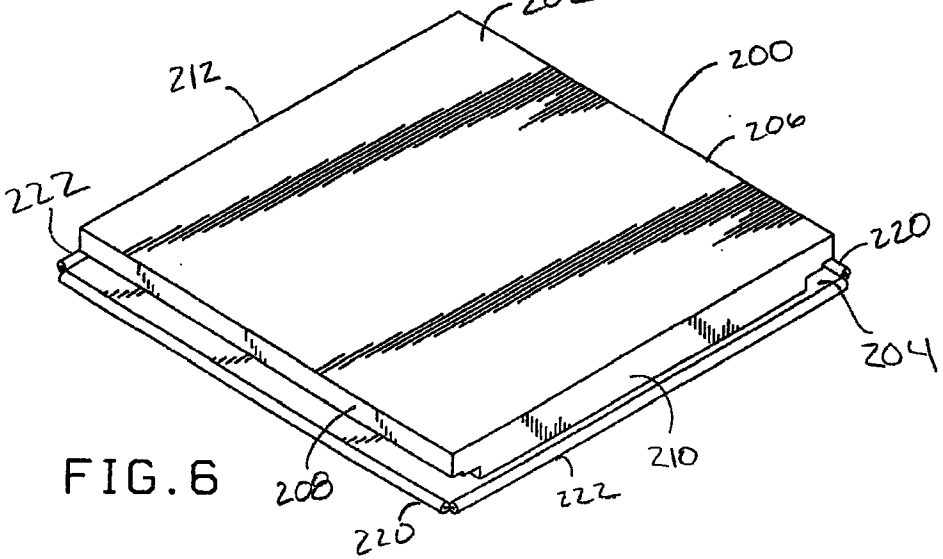
FIG. 6 is a perspective view of a second embodiment of a ceiling panel embodying features of the present invention.
Figure 7:
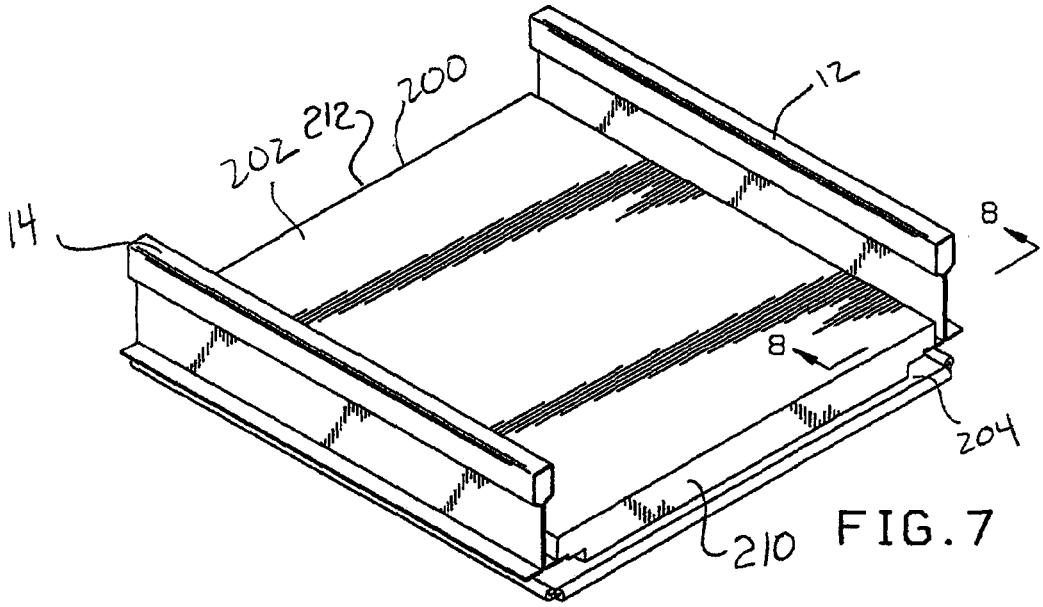
FIG. 7 is a perspective view of the ceiling panel of FIG. 6 as suspended from grid runners.
Figure 8:
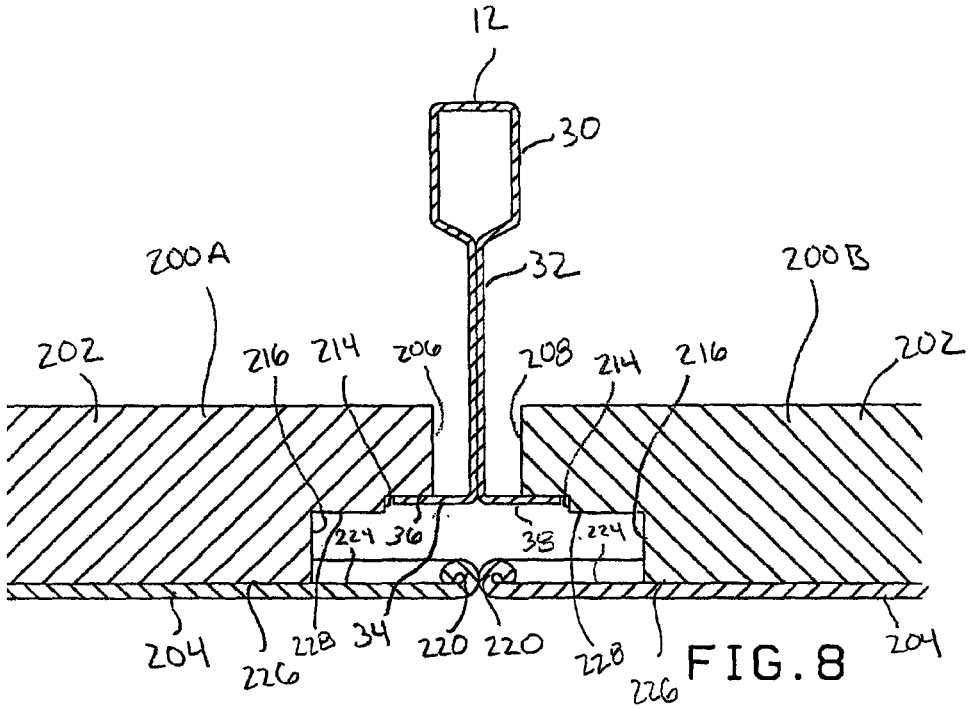
FIG. 8 is a cross-sectional view of the ceiling panel and grid runner of FIG. 7 as taken along line 8-8 thereof, with an adjacent ceiling panel suspended from the grid runner.

In this embodiment, the facing material 204 of the ceiling panel 200 is generally thinner than the facing material 104 of ceiling panel 100. To give the edge regions of the facing material 204 thickness and rigidity, each pair of opposing perimeter edge regions 220, 222 of the facing material 204 are rolled, as shown in FIG. 6. As can be seen in the cross-sectional view of FIG. 8, the rolled edge regions 220 are formed by rolling the edge regions of the facing material 204 back over on top of the upper face 224 of the facing material. The other pair of perimeter edge regions 222 of the facing material 204 also are rolled in the same manner. To fully conceal the grid structure 22, the perimeter rolled edge regions 220 of the adjacent facing material 204 of ceiling panels 200A and 200B extend to touch and seat flush against each other such that the flange 34 is fully concealed, as shown in FIG. 8. It also is appreciated that the other pair of perimeter rolled edge regions 222 extend to conceal the cross tee grid runners and also may mate with the edge region 222 of an adjacent ceiling panel to fully conceal the cross tee grid runners. As a result, the facing material 204 fully conceals the main tee grid runners and the cross tee grid runners to provide a monolithic suspended ceiling appearance.

Figure 9:
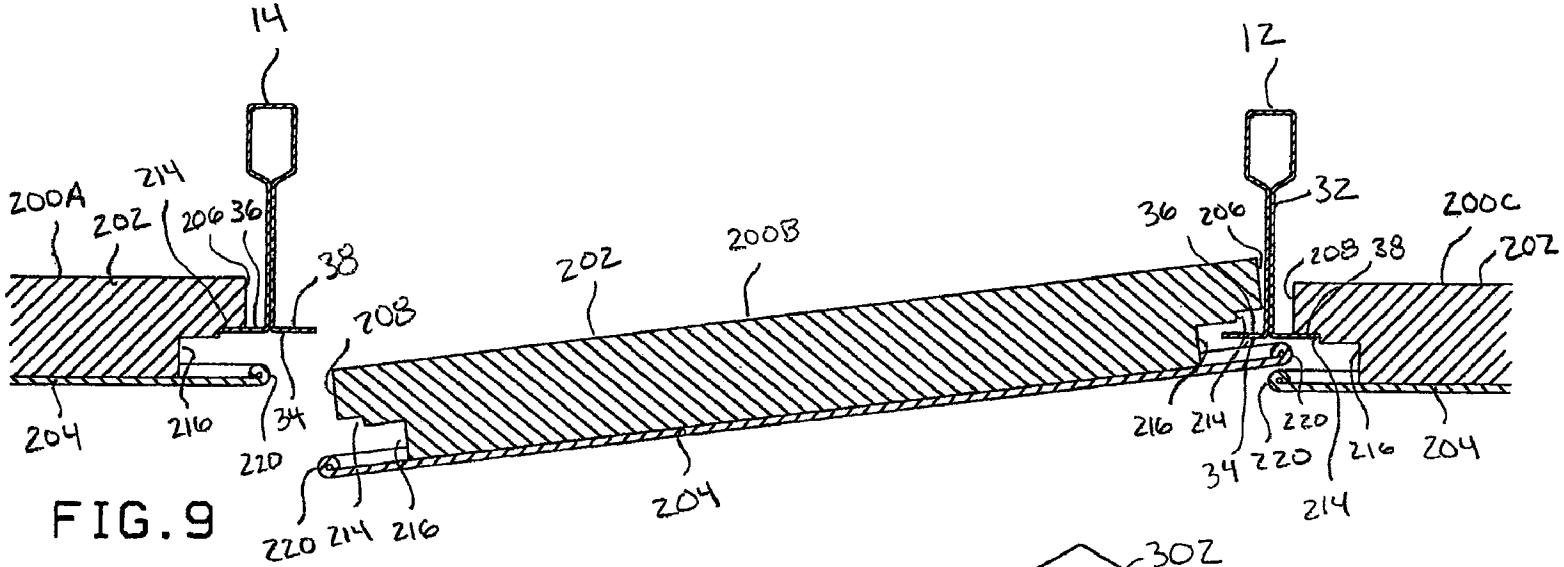
FIG. 9 is a cross-sectional view of a plurality of the suspended ceiling panels and grid runners shown in FIG. 8, showing the installation or removal of one of the ceiling panels.
Figure 10:
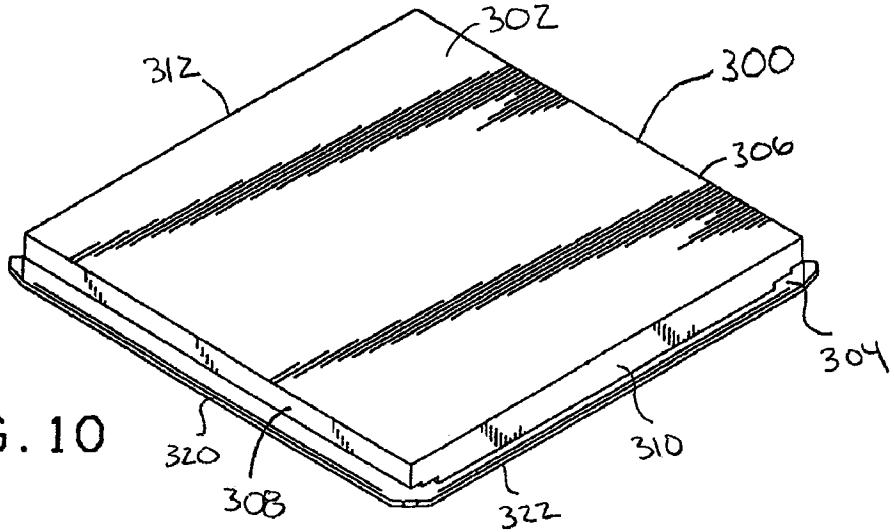
FIG. 10 is a perspective view of a third embodiment of a ceiling panel embodying features of the present invention.
Figure 11:
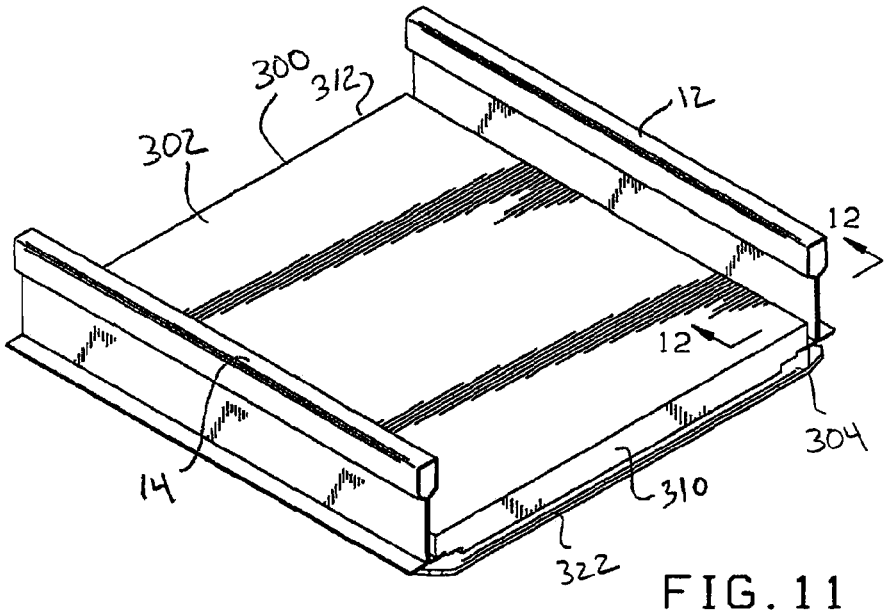
FIG. 11 is a perspective view of the ceiling panel of FIG. 10 as suspended from grid runners.

FIG. 9 illustrates a ceiling panel 200 being installed and/or removed from a suspended position within the grid 22 using a lift-and-shift motion. Again, the installation of the ceiling panel 200 of this embodiment is accomplished by reversing the removal steps. FIG. 9 shows adjacent parallel main tee grid runners 12, 14 with a series of three adjacent ceiling panels 200A, 200B, and 200C. To remove ceiling panel 200B, the same general series of steps are followed as outlined above for ceiling panel 100B. That is, the ceiling panel 200B is lifted vertically until the facing material 204 along sides 206, 208 is generally adjacent the flanges 34 of main tee grid runners 12, 14 and positioned above the facing material 204 of adjacent ceiling panels 200A and 200C. The ceiling panel 200B is then shifted to the right toward ceiling panel 200C. When the ceiling panel 200B is shifted to the right, the facing material 204 on side 206 of the ceiling panel 200B is inserted in the space between flange 34 of main tee grid runner 12 and the facing material 204 of ceiling panel 200C. In addition, side 36 of the main tee grid runner 12 is positioned within the positioning kerf 216 of side 206 of the ceiling panel 200B. As the ceiling panel 200B is further shifted to the right, the tile base 202 of the opposing side 208 of the ceiling panel 200B shifts clear of the flange 34 of main tee grid runner 14 and is able to drop down. As the side 208 of the ceiling panel 200B continues to drop, the facing material 204 of side 206 is removed from the space between the flange 34 of main tee grid runner 12 and the facing material 204 of ceiling panel 200C and also is free to drop down such that panel 200B can be removed.

Referring now to FIGS. 10-14, there is illustrated a third embodiment of a ceiling panel 300 to be used in the grid structure 22 of FIG. 1. As with ceiling panels 100 and 200, the ceiling panel 300 of this embodiment comprises a tile base 302 and a facing material 304 secured across a lower face 336 of the tile base 302. The core tile or tile base 302 has generally the same configuration as the tile base 102 of ceiling panel 100, including a stepped perimeter profile 328 along a pair of opposing edge regions 306, 308 and vertically extending linear walls along a pair of opposing side regions 310, 312. The stepped perimeter profile 328 is comprised of a horizontal support kerf 314 and a horizontal positioning kerf 316 positioned below the support kerf 314, with each kerf 314, 316 configured similarly to the kerfs 114, 116 of ceiling panel 100.

The facing material 304 of the ceiling panel 300 has a first pair of opposing edge regions 320 adjacent the stepped profile 328 of edge regions 306, 308 of the tile base 302 and a second pair of opposing edge regions 322 adjacent the side regions 310, 312 of the tile base 302. As with the facing material 104 of ceiling panel 100, the facing material 304 of this embodiment is sized to extend beyond an edge of the lower face 336 of the tile base 302. The facing material 304 preferably extends beyond the tile base 302 around the entire perimeter of the tile base 302. The facing material 304 conceals the stepped profile 328 of the opposing edge regions 306, 308 of the core panel 302 during suspension when viewed from below, in addition to at least partially concealing the grid 22 during suspension.

Figure 12:
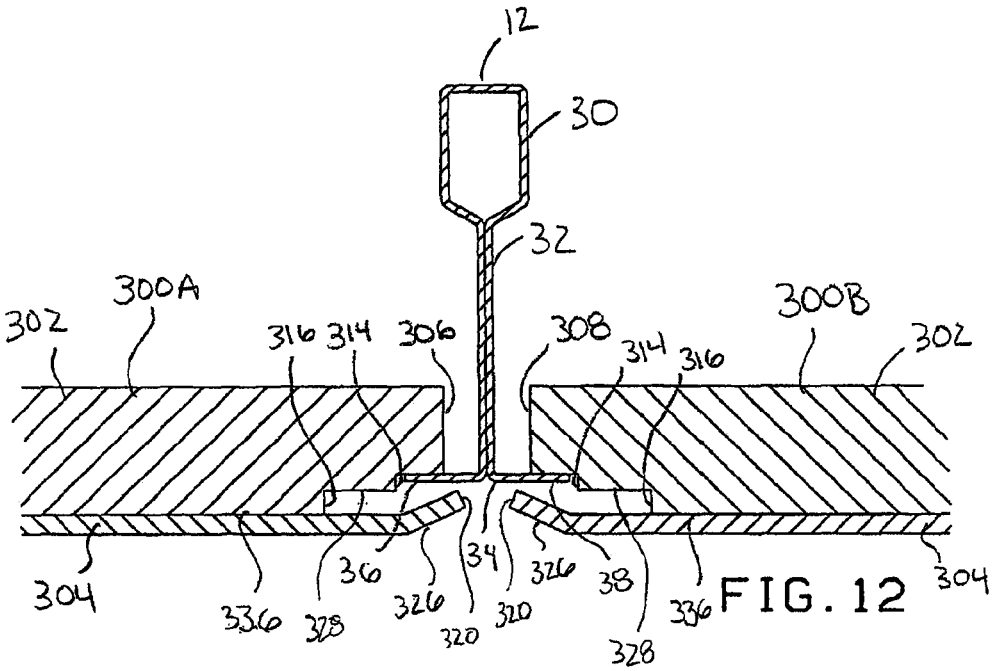
FIG. 12 is a cross-sectional view of the ceiling panel and grid runner of FIG. 11 as taken along line 12-12 thereof, with an adjacent ceiling panel suspended from the grid runner.
Figure 13:
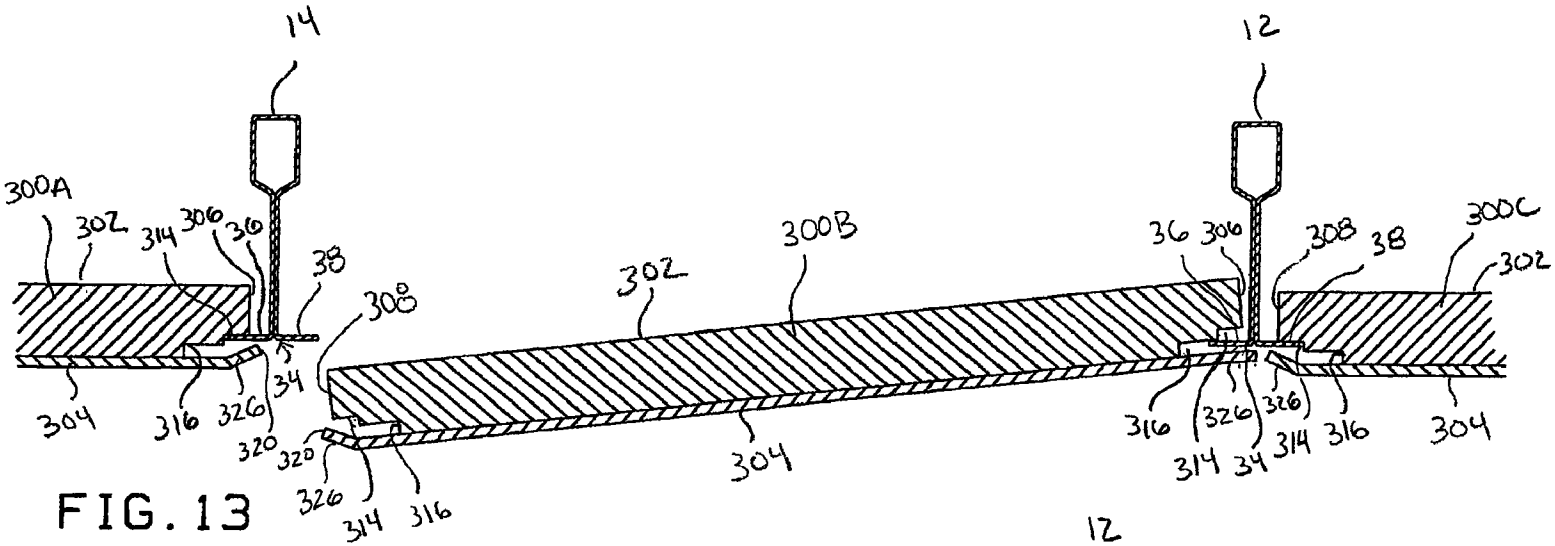
FIG. 13 is a cross-sectional view of a plurality of the suspended ceiling panels and grid runners shown in FIG. 12, showing the installation or removal of one of the ceiling panels.
Figure 14:
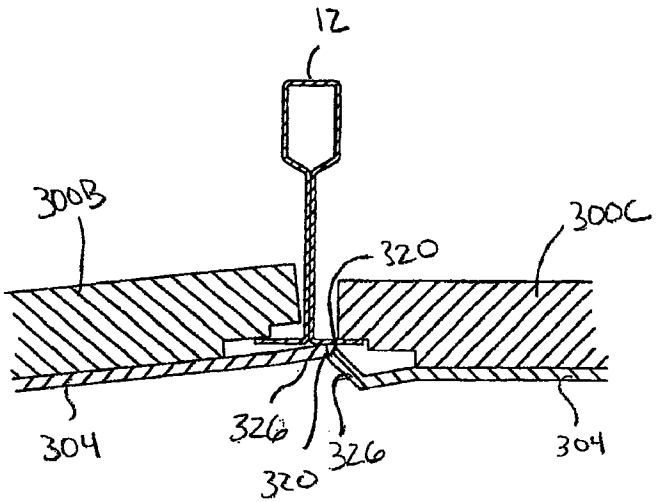
FIG. 14 is a cross-sectional view of the ceiling panel and grid runner of FIG. 12, showing an additional view of the installation or removal of one of the ceiling panels.
Figure 15:
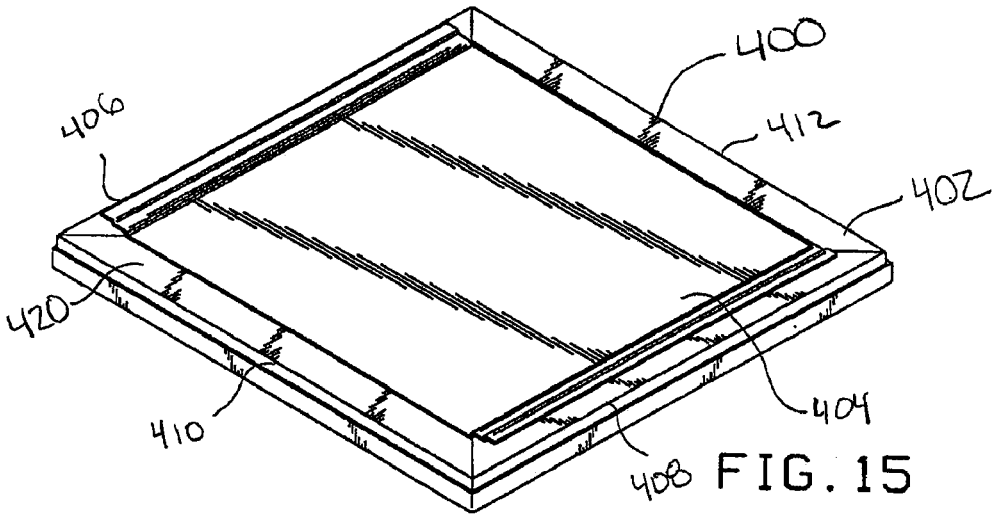
FIG. 15 is a perspective view of a fourth embodiment of a ceiling panel embodying features of the present invention.

In this embodiment, an edge segment 326 of the facing material 304 is upturned toward the tile base 302. The facing material 304 preferably has upturned edge segments 326 along the entire perimeter of edge regions 320, 322. As shown in FIG. 12, when the ceiling panel 300 is suspended from a main tee grid runner 12, the upturned edge segments 326 of adjacent ceiling panels 300A and 300B are angled toward the flange 34 of the grid runner 12. As a result, the upturned edge segments 326 conceal the stepped profile 328 of the opposing edge regions 306, 308 of the tile base 302 and also partially conceal the flange 34 of the grid runner 12. It also is appreciated that upturned edge segments 326 adjacent opposing side regions 310, 312 partially conceal the cross tee grid runners. The facing material 304, including the upturned edge segments 326, is preferably made of a resilient flexible material. The resilient nature of the material will assist in the installation and removal of the ceiling panel 300. While the ceiling panel 300 is shown to partially conceal the grid runners, in alternative embodiments the edge regions 320 may have edge segments upturned at such an angle and/or have a certain length to entirely conceal the grid runners, FIGS. 13 and 14 illustrate a ceiling panel 300 being installed and/or removed from a suspended position within the grid 22 using a lift-and-shift motion. Again, the basic steps are generally the same as those described for ceiling panels of 100 and 200. The installation of the ceiling panel 300 of this embodiment is accomplished by reversing the removal steps. FIG. 13 shows adjacent parallel main tee grid runners 12, 14 with a series of three adjacent ceiling panels 300A, 300B, and 300C. To remove ceiling panel 300B, the same general series of steps are followed as outlined above for ceiling panel 100B. The ceiling panel 300B first is lifted vertically until the flanges 34 of main tee grid runner 12, 14 are generally aligned with the positioning kerf 314 of sides 306, 308 of the ceiling panel 300B, with the upturned edge segment 326 of the resilient facing material 304 flattening as the upturned edge segment 326 is forced into contact with the flange 34. The ceiling panel 300B is then shifted to the right toward ceiling panel 300C. When the ceiling panel 300B is shifted to the right, the outer edge region 320 of the now flattened upturned edge segment 326 of ceiling panel 300B pushes against the outer edge region 320 of adjacent upturned edge segment 326 of ceiling panel 300C, causing the upturned edge segment 326 of ceiling panel 300C to flex to create a deeper bend in the facing material 304, as illustrated in FIG. 14. As a result, the ceiling panel 300B is able to shift further to the right. Due to the resilience of the facing material 304, the facing material 304 of ceiling panel 300C absorbs the force applied by the facing material 304 of ceiling panel 300B by flexing and the contact does not result in the ceiling panel 300C being pushed off of the main tee grid runner 12. As the ceiling panel 300B is further shifted to the right, the tile base 302 of the opposing side 308 of the ceiling panel 300B shifts clear of the flange 34 of main tee grid runner 12 and is then able to drop down. As the side 308 of the ceiling panel 300B continues to drop, the facing material 304 of side 306 is removed from the space between the flange 34 of main tee grid runner 12 and the facing material 304 of ceiling panel 300C and also is free to drop down such that panel 300B can be removed. As the straightened upturned edge segment 326 of the facing material 304 of ceiling panel 300B moves out of contact with the flange 34, the resilient nature of the facing material 304 causes the upturned edge segment 326 to return to the original upturned shape. Likewise, as the upturned edge segment 326 of ceiling panel 300C moves out of contact with the upturned edge segment 326 of ceiling panel 300B, the upturned edge segment 326 releases from the deeper bend and returns to the original upturned shape.

Referring now to FIGS. 15-22, there is illustrated a fourth embodiment of a ceiling panel 400 to be used in the grid structure 22 of FIG. 1. The ceiling panel of this embodiment comprises a frame 402 and a facing material 404 secured across the frame 402. Again, both the frame 402 and the facing material 404 are shown as being generally rectangular in shape, although other shapes are contemplated. The facing material 404 generally functions to provide an aesthetically pleasing and generally monolithic ceiling appearance. The frame 402 provides a support structure to which the facing material 404 is secured and also provides the suspension structure for the ceiling panel 400 such that the ceiling panel 400 engages with and is supported by the grid 22.

Figure 17:
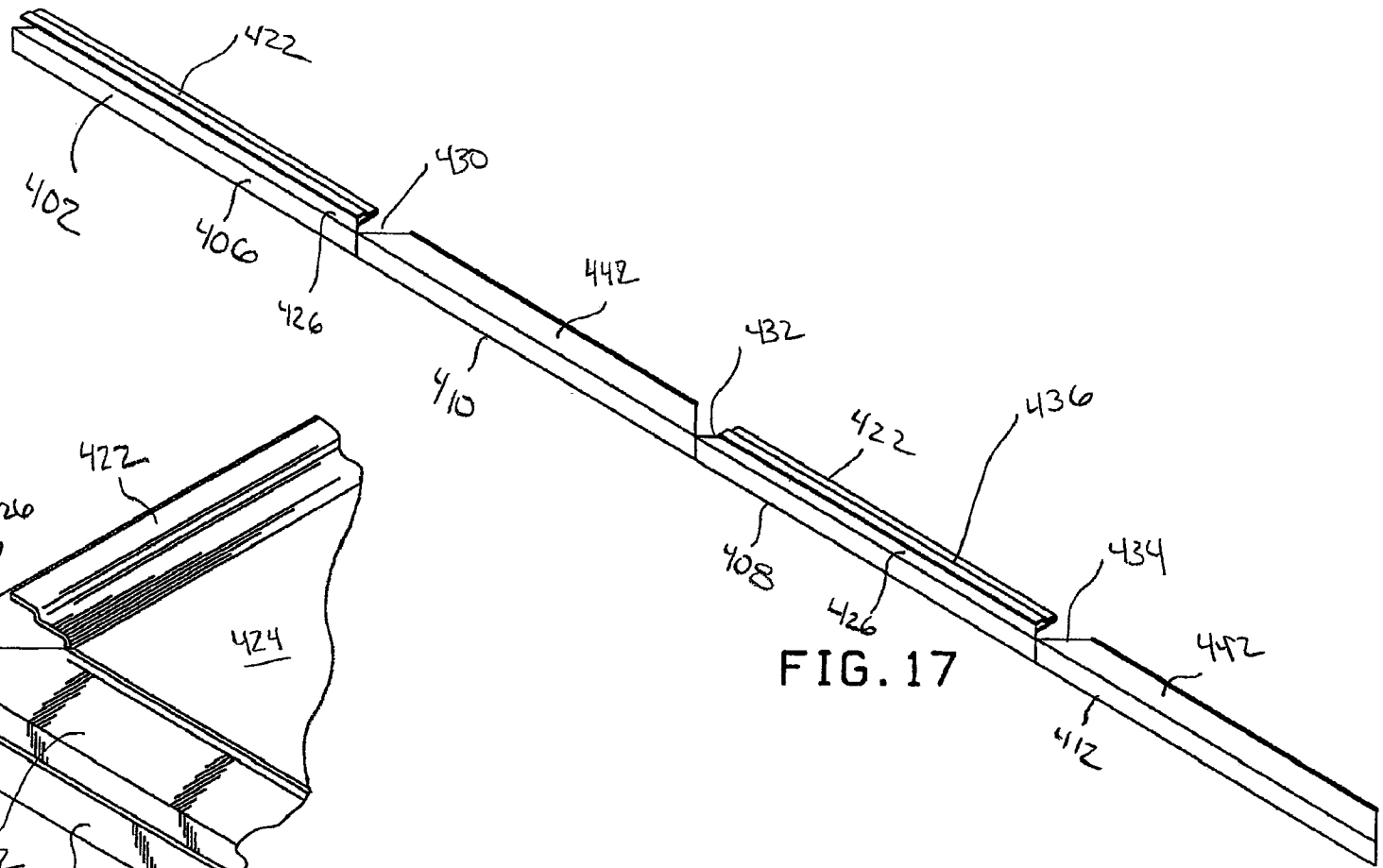
FIG. 17 is a perspective view of the frame of FIG. 16, with the frame in an unassembled configuration.
Figure 18:
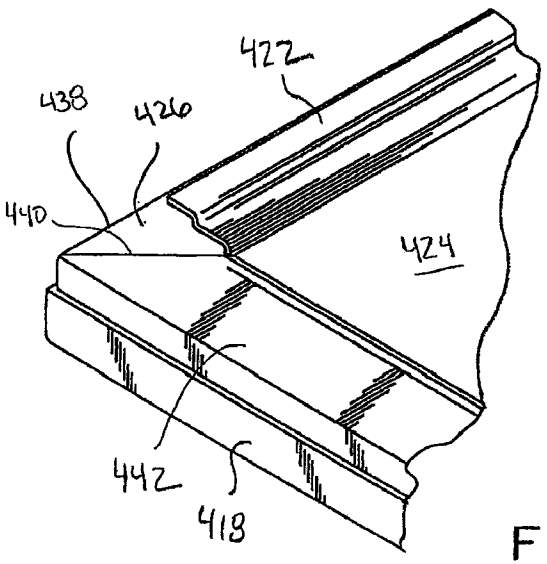
FIG. 18 is a fragmentary perspective view of a corner of the ceiling panel of FIG. 15.

In this embodiment, the frame 402 generally comprises a base frame portion 420 having a first pair of opposing side wall segments 406, 408 and a second pair of opposing side wall segments 410, 412. Referring now to FIG. 17, the frame 402 is preferably formed from a length 436 of roll-formed metal. The general profile of each side wall segment 406, 408, 410, 412 is formed during the roll-forming process. The frame 402 is factory adjustable by making varying lengths 436 of the roll-formed metal such that varying widths and lengths of ceiling panels 400 can be produced. Notches 430, 432, 434 are then formed in the roll-formed length 436 such that the length 436 can be folded or bent at each notch 430, 432, 434 to assemble the frame 402. As is illustrated in the corner detail shown in FIG. 18, each corner 438 may optionally have an overlapping tab 440 for spot welding to secure the frame 402 in its assembled form.

Figure 16:
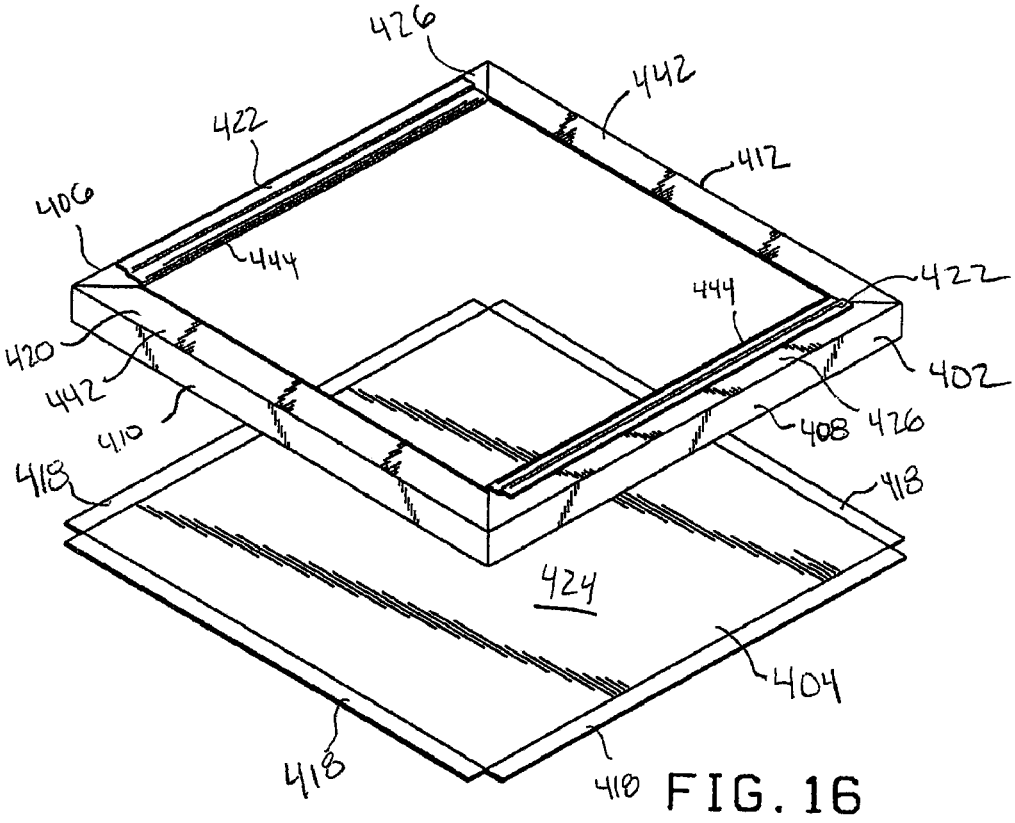
FIG. 16 is an exploded perspective view showing the frame and facing material of the ceiling panel of FIG. 15.

When assembled, the side wall segments 406, 408, 410, 412 define a generally rectangular border frame to which the facing material 404 is secured. As illustrated in FIG. 16, the facing material 404 of this embodiment has center portion 424 having a generally rectangular configuration, with the center portion 424 being sized to generally match the size of the frame 402. In addition, the facing material 404 includes flap portions 418 along each side of the center portion 424. The center portion 424 of the facing material 404 extends across the bottom of the side wall segments 406, 408, 410, 412, and the flap portions 418 are then folded up along the side wall segments 406, 408, 410, 412 and secured thereto. The flap portions 418 are secured to the side wall segments 406, 408, 410, 412 using any suitable securing means, such as, for example, by chemically attaching the flap portions 418 using a glue or adhesive or any known mechanical means.

In this embodiment, the base frame portion 420 of the frame 402 has a first pair of top facing walls 426 extending generally transverse to side wall segments 406, 408 and a second pair of top facing walls 442 extending generally transverse to side wall segments 410, 412. The first pair of top facing walls 426 each has a support extension 422 extending therefrom, with the support extension 422 extending from a rolled edge 444 of the top facing walls 426 and toward the outer side wall segments 406, 408. The support extension 422 extends over generally two-thirds of the top facing wall 426 and extends generally along the entire length of the top facing wall 426. The support extension 422 has a stepped perimeter profile 428 for being supported by a main tee grid runner during suspension. By another optional approach, a plurality of shortened support extensions may be positioned along the length of the top facing wall 426.

Figure 19:
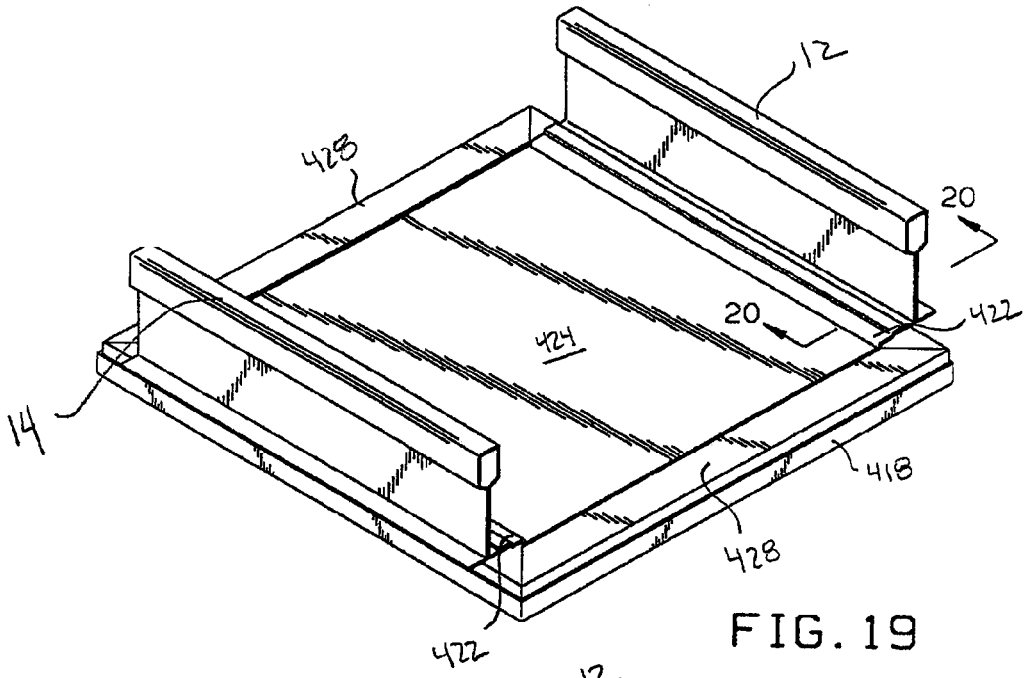
FIG. 19 is a perspective view of the ceiling panel of FIG. 15 as suspended from grid runners.
Figure 20:
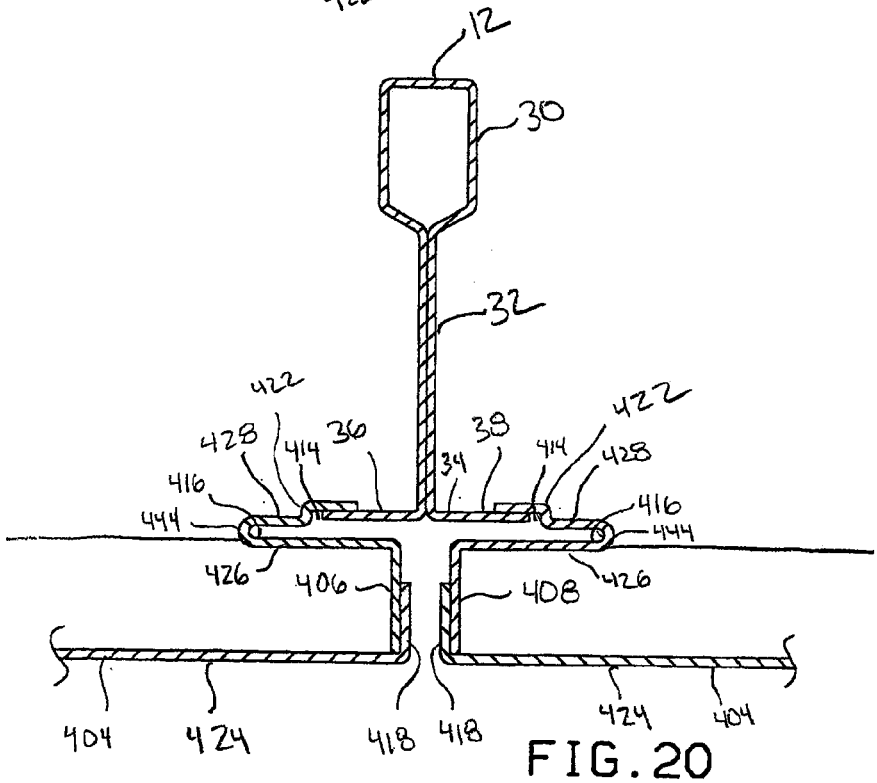
FIG. 20 is a cross-sectional view of the ceiling panel and grid runner of FIG. 19 as taken along line 20-20 thereof, with an adjacent ceiling panel suspended from the grid runner.

The stepped profile 428 of each support extension 422 is comprised of a horizontal support step 414 starting from the outermost end region of the support extension 422. A horizontal positioning step 416 is formed below the support step 414, with the horizontal positioning step 416 extending to the rolled edge 444 of the top facing wall 426. The support step 414 of this embodiment generally functions to provide a suspension surface for the ceiling panel 400, with the support step 414 being supported by the flange 34 of the main tee grid runner 12 during suspension of the ceiling panel 400, as illustrated in FIGS. 19 and 20. The support step 414 also assists in accurately positioning the ceiling panel 400 on the grid flange 34. As shown, the support step 414 has a height generally equal to the thickness of the flange 34 of the main tee grid runner 12. The positioning step 416 allows for the lift and shift installation and/or removal of the ceiling panel 400 from the grid 22.

Figure 21:
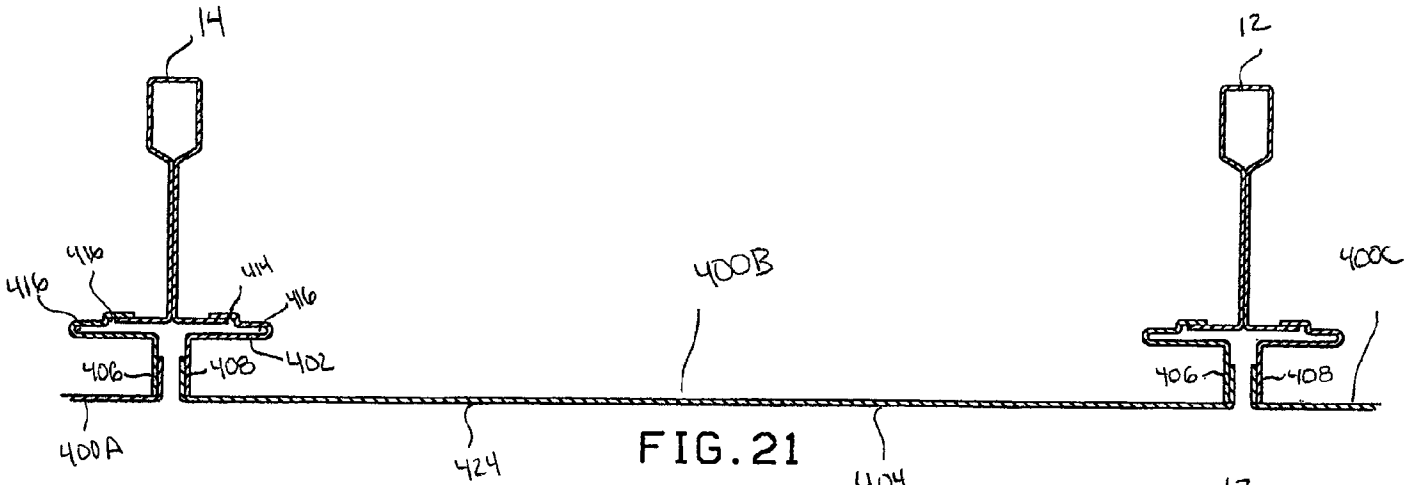
FIG. 21 is a cross-sectional view of a plurality of the suspended ceiling panels and grid runners shown in FIG. 20.

FIGS. 19-21 show the installed condition of the ceiling panel 400. The ceiling panel 400 of this embodiment is supported on opposing side walls 406, 408 by the support extensions 422 hanging on the flange 34 of the main tee grid runners 12, 14, with the support step 414 of each support extension 422 engaging with the grid flange 34. When suspended, the top facing wall 420 of the frame 402 extends under a side 36, 38 of the grid flange 34 to partially conceal the main tee grid runner 12. The frame 402 is then generally, if not fully, concealed by the facing material 404 secured thereto. As a result, when viewed from below, the main tee grid runners 12, 14 are at least partially concealed by the facing material 404 to provide a more monolithic appearance.

Figure 22:
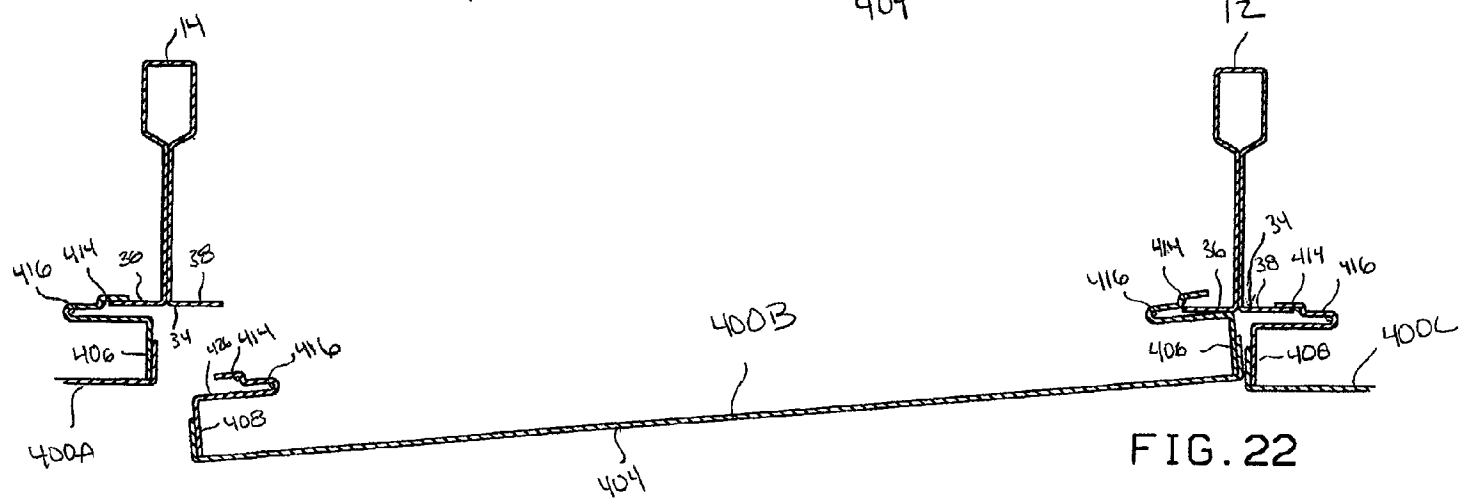
FIG. 22 is a cross-sectional view of the suspended ceiling panels and grid runners of FIG. 21 showing the installation or removal of one of the ceiling panels.
Figure 23:
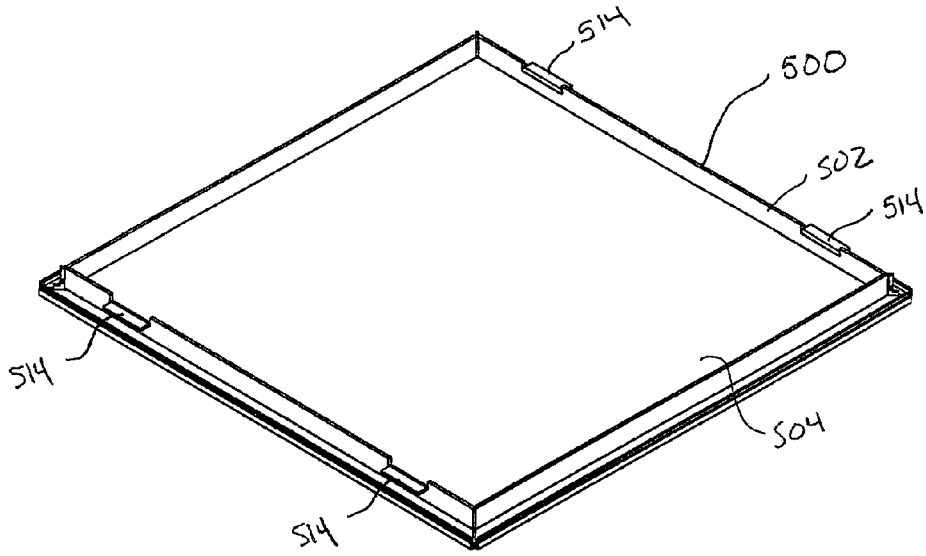
FIG. 23 is a perspective view of a fifth embodiment of a ceiling panel embodying features of the present invention

FIG. 22 illustrates a ceiling panel 400 of this embodiment being installed and/or removed from a suspended position within the grid 22 using a lift-and-shift motion. Adjacent parallel main tee grid runners 12, 14 are shown with a series of three adjacent ceiling panels 400A, 400B, and 400C. In this illustration, ceiling panel 400B is being removed. As the ceiling panels are symmetrical in that there is a support extension 422 having a stepped profile 428 along opposing top facing walls of the frame 402, it is understood that the installation and/or removal may be performed using the features of either support extension 422.

To begin removal, the ceiling panel 400B of this embodiment is lifted vertically until the top facing wall 426 contacts the flange 34 of each main tee grid runner 34 and the flange 34 is generally aligned with the positioning step 416 along side walls 406, 408. The ceiling panel 400B is then shifted to the right toward ceiling panel 400C. When the ceiling panel 400B is shifted to the right, the flange 34 of main tee grid runner 12 is inserted into the positioning step 416 of the support extension 422 on side wall 406. As the ceiling panel 400B is further shifted to the right, the support extension 422 of side wall 408 shifts clear of the flange 34 of main tee grid runner 14 and is able to drop down. As the side wall 408 of the ceiling panel 400B continues to drop, the facing material 404 of side wall 406 is removed from the space between the flange 34 of main tee grid runner 12 and the facing material 404 of ceiling panel 400C and is also free to drop down such that panel 400B can be removed.

With reference to FIGS. 23-32, there is illustrated a perspective view of a fifth embodiment of a ceiling panel 500, to be used in the grid structure 22 of FIG. 1. The ceiling panel 500 of this embodiment comprises a frame 502 and a facing material 504 secured across the frame 502. The facing material 504 provides an aesthetically pleasing and generally monolithic ceiling appearance. The frame 502 provides support structure to which the facing material 504 is secured and also provides the suspension structure for the ceiling panel 500 such that the ceiling panel 500 engages with and is supported by the grid 22.

Figure 24:
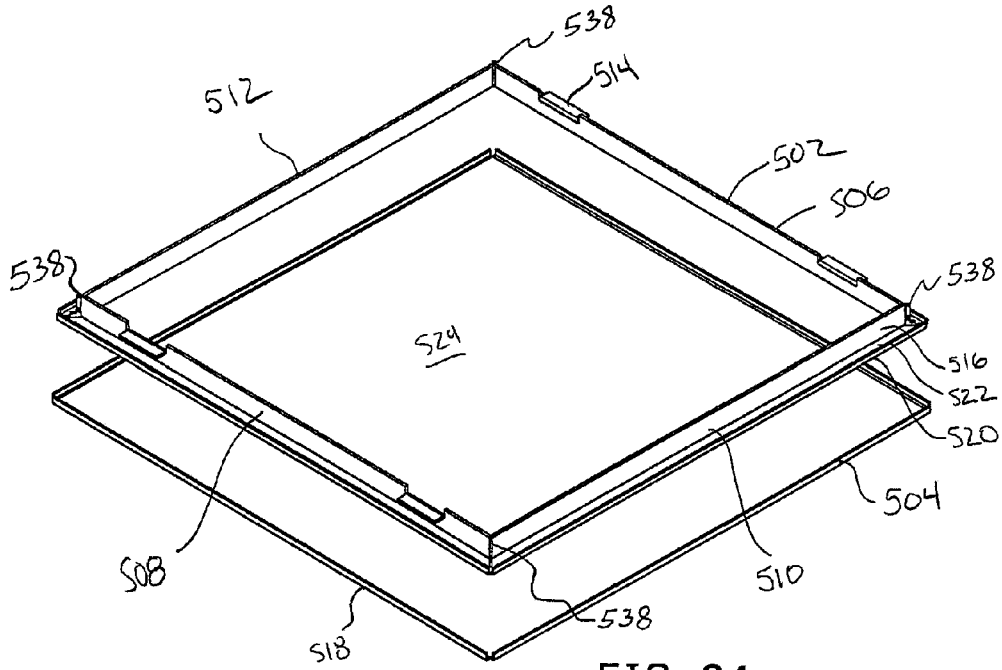
FIG. 24 is an exploded perspective view showing the frame and facing material of the ceiling panel of FIG. 23.

The frame 502 of this embodiment generally comprises a first pair of opposing sides 506, 508 and a second pair of opposing sides 510, 512. The sides 506, 508, 510, 512 form a generally rectangular border frame to which the facing material 504 is secured. As illustrated in FIG. 24, the facing material 504 has a center portion 524 having a generally rectangular configuration, with the center portion 524 being sized to generally match the size of the frame 502. In addition, the facing material 504 includes flap portions 518 along each side of the center portion 524, which are secured to the frame 502.

In this embodiment, the frame 502 has upstanding main walls 516 and base walls 522 along each side 506, 508, 510, 512 that are generally perpendicular to the main walls 516 to form a generally L-shaped cross-section. A lip 520 extends away transversely from a distal end of the base wall 522. The flap portions 518 of the facing material 504 are secured to the lip 520 of each side 506, 508, 510, 512. Along each side 506, 508, a pair of support flanges 514 are formed generally perpendicular to the main wall 516. The support flanges 514 are each bent outwardly of the frame 502, with the support flanges 514 being used to support the ceiling panel 500 during suspension. The support flange 514 extends generally parallel to the base wall 522, with the base wall 522 extending further in length than the support flange 514. Each support flange 514 on side 506 is generally aligned laterally with the support flanges 514 on the opposing side 508. Each support flange 514 is positioned generally adjacent a corner 538 of the frame 502, although other locations are contemplated. Although a pair of flanges 514 are shown on each side 506, 508, it should be noted that there may be any number of support flanges 514 along the sides 506, 508, with the support flanges 514 positioned anywhere along the length of the sides 506, 508. In addition, the support flanges 514 may be any length and, by one optional approach, a single support flange 514 may extend the length of a side 506, 508.

Figures 25, 26:
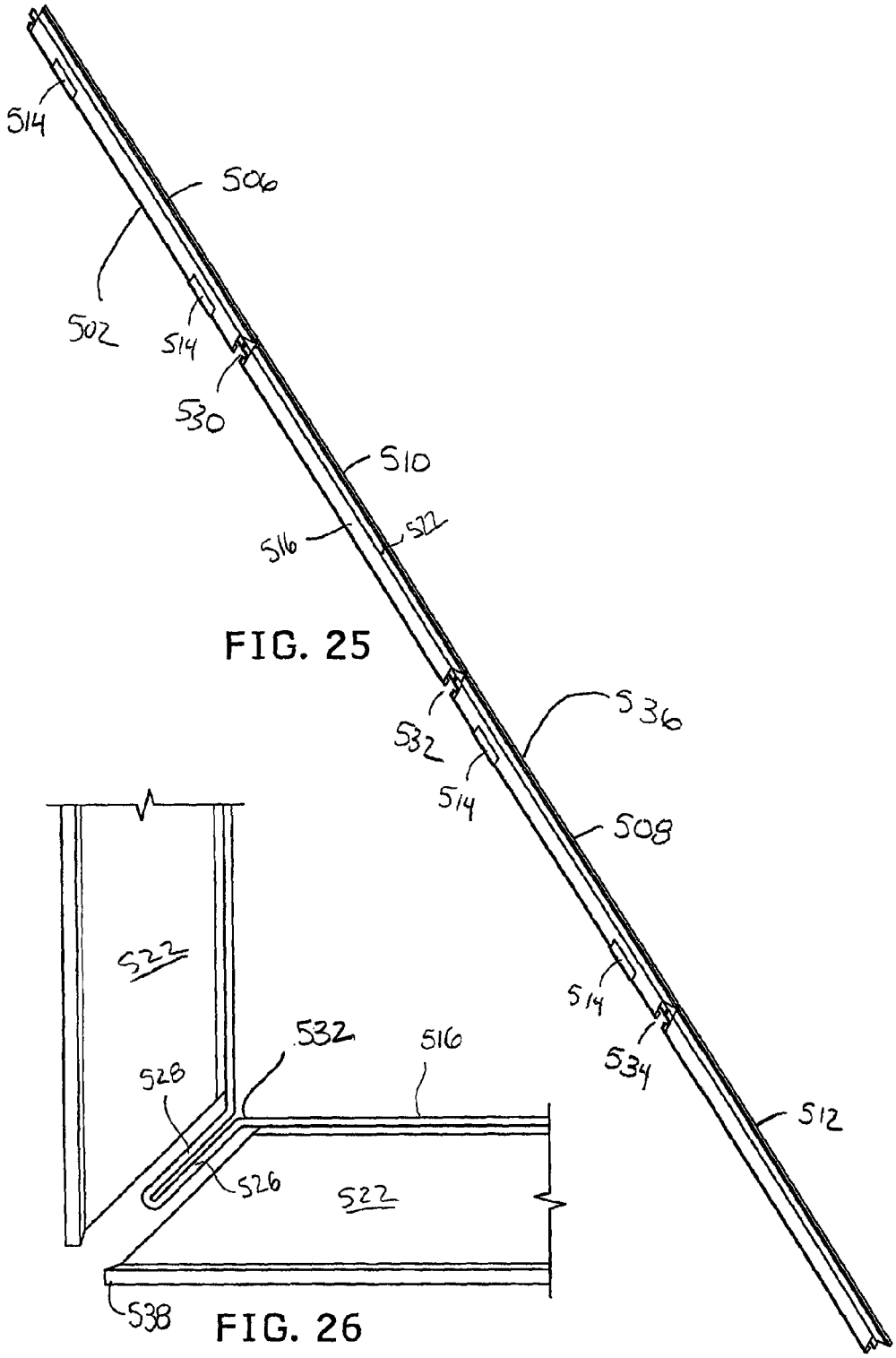
FIG. 25 is a perspective view of the frame of FIG. 24, with the frame in an unassembled configuration.
FIG. 26 is a fragmentary top view of a corner of the ceiling panel of FIG. 23.

Referring now to FIG. 25, the frame 502 of this embodiment is preferably formed from a length 536 of roll-formed metal. The general profile of each side walls 506, 508, 510, 512 is formed during the roll-forming process. The frame 502 is factory adjustable by making varying lengths 536 of the roll-formed metal such that varying widths and lengths of ceiling panels 500 can be produced. Support flanges 514 are then cut along the length 536. Notches 530, 532, 534 are then formed in the roll-formed length 536 such that the length 536 can be hinged and folded or bent at each notch 530, 532, 534 to assemble the frame 502. After folding, each corner 538 may optionally be spot welded to secure the frame 502 in its assembled form.

Figure 27:
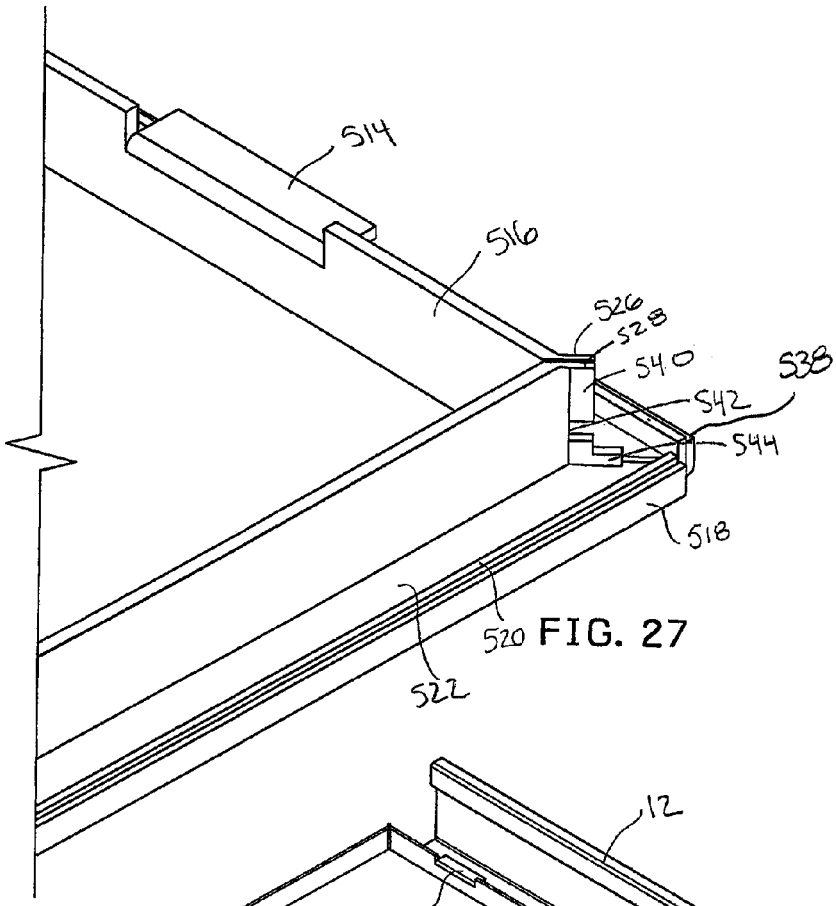
FIG. 27 is a fragmentary perspective view of a corner of the ceiling panel of FIG. 23.

As is illustrated in the corner details shown in FIGS. 26 and 27, the notches 530, 532, 534 formed along the frame length 536 form a corner 538 with a specific profile when folded. FIG. 26 shows a top view of a corner of this embodiment, and FIG. 27 shows a perspective view of a corner 538. Corner angled walls 526, 528 extend from the main wall 516. The walls 526, 528 are folded to seat flush against each other and each has an identical profile, including a rectangular wall 540 and a stepped wall 544. The rectangular wall 540 and the stepped wall 544 are separated by a notch 542.

Figure 28:
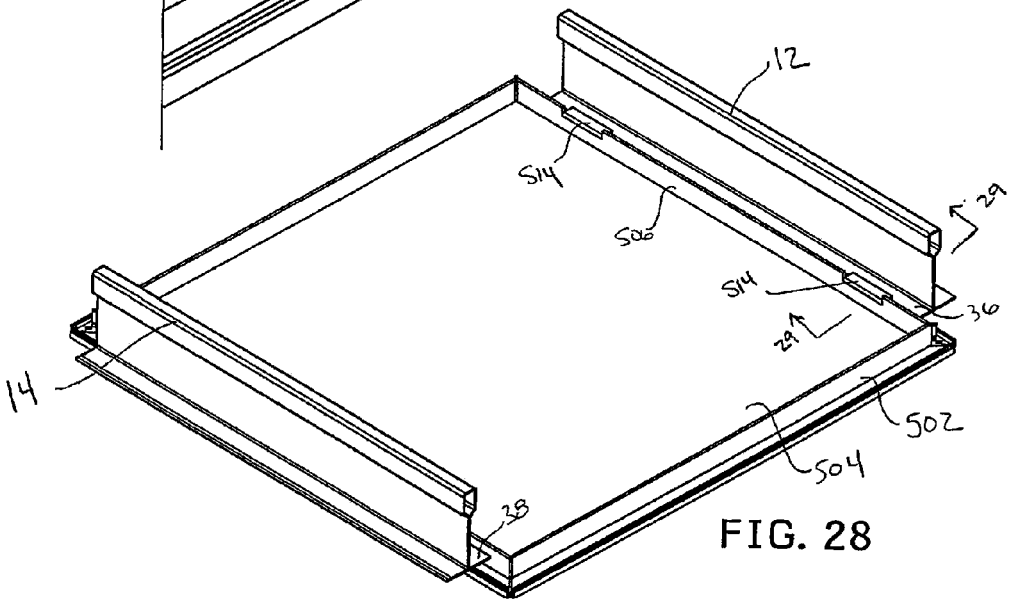
FIG. 28 is a perspective view of the ceiling panel of FIG. 23 as suspended from grid runners.
Figure 29:
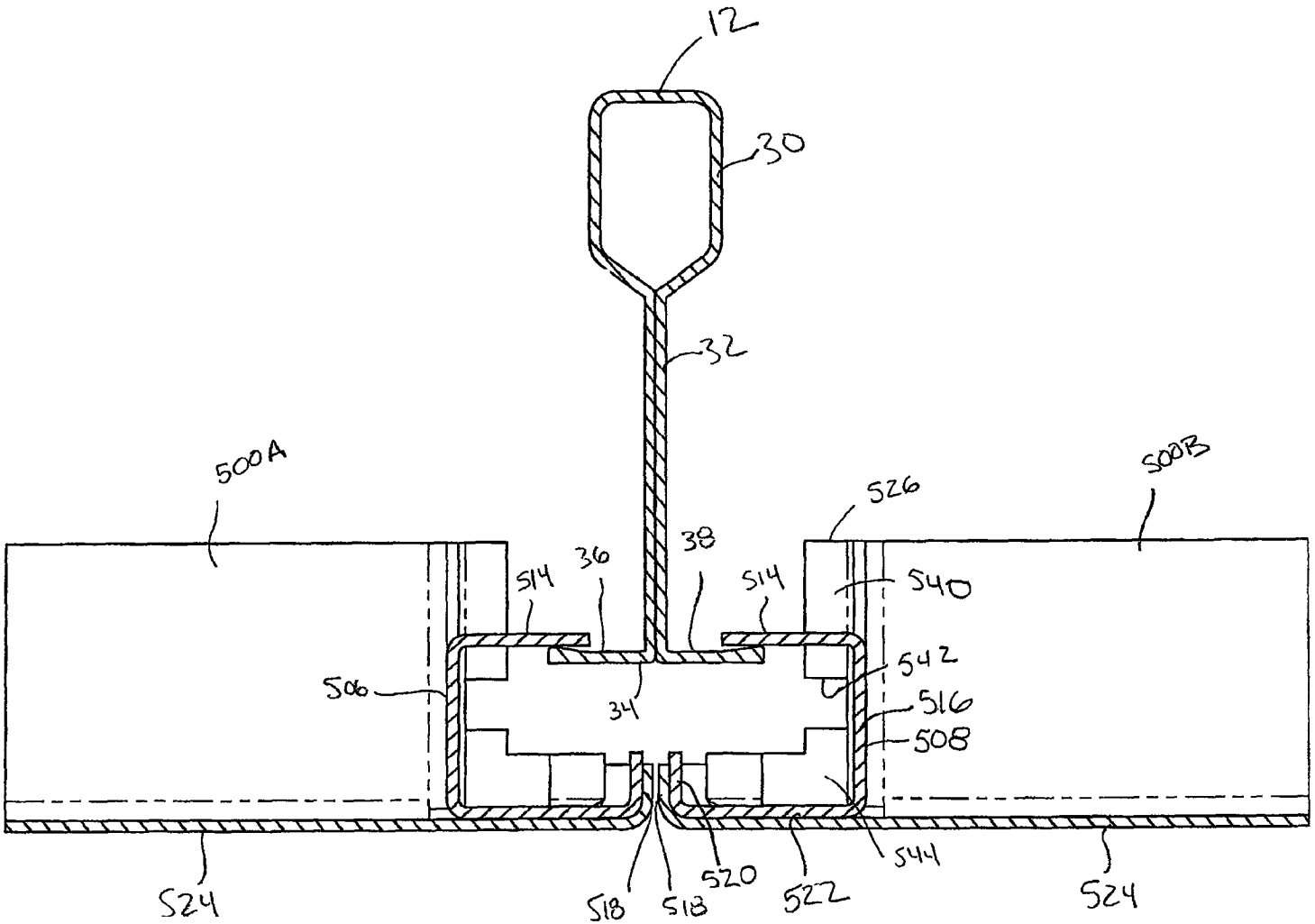
FIG. 29 is a cross-sectional view of the ceiling panel and grid runner of FIG. 28 as taken along line 29-29 thereof, with an adjacent ceiling panel suspended from the grid runner.
Figure 30:
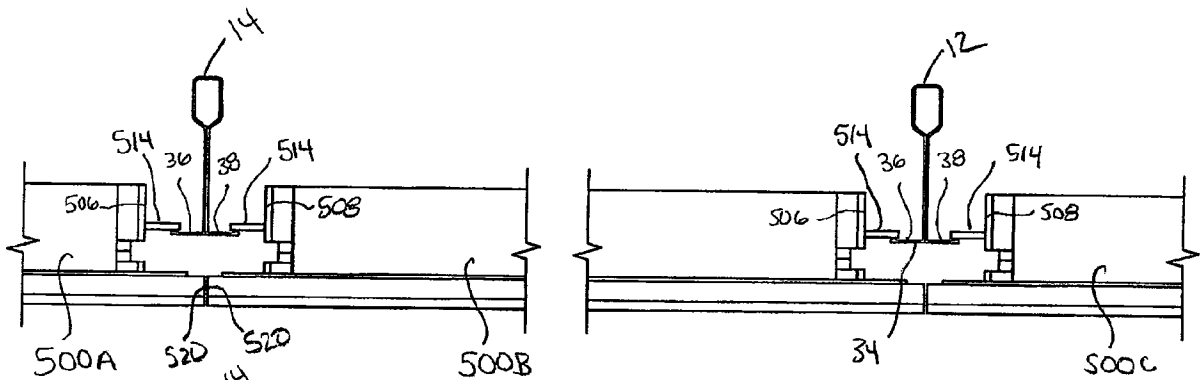
FIG. 30 is a side view of a plurality of the suspended ceiling panels and grid runners shown in FIG. 30.

FIGS. 28-30 show the installed condition of the ceiling panel 500. The ceiling panel 500 of this embodiment is supported on opposing side walls 506, 508 by the support flanges 514 hanging on the flange 34 of the main tee grid runners 12, 14. When suspended, the base wall 522 of the frame 502 extends under a side 36, 38 of the grid flange 34 to at least partially conceal the main tee grid runner 12. The frame 502 is then fully concealed by the facing material 504 being secured thereto. In addition, the flap portion 518 secured to the lip 520 serves to fill the space between the lips 520 of the adjacent ceiling panels 500A and 500B to further conceal the main tee grid runner 12. As a result, when viewed from below, the main tee grid runners 12, 14 are at least partially concealed by the facing material 504 to provide a generally monolithic appearance. In addition, the base wall 522 of the frame 502 along opposing sides 510, 512 conceals the cross tee grid runners in the same manner.

Figure 31:
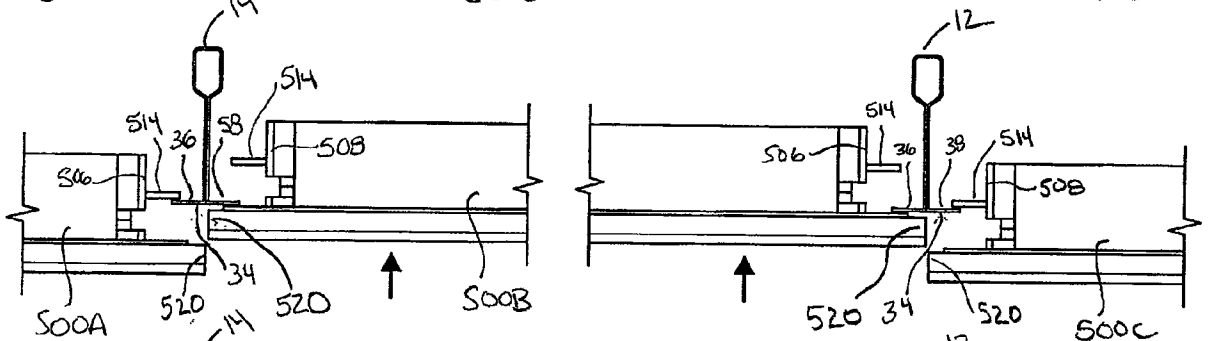
FIG. 31 is a side view of the suspended ceiling panels and grid runners of FIG. 30 showing a first step in the removal of one of the ceiling panels.
Figure 32:
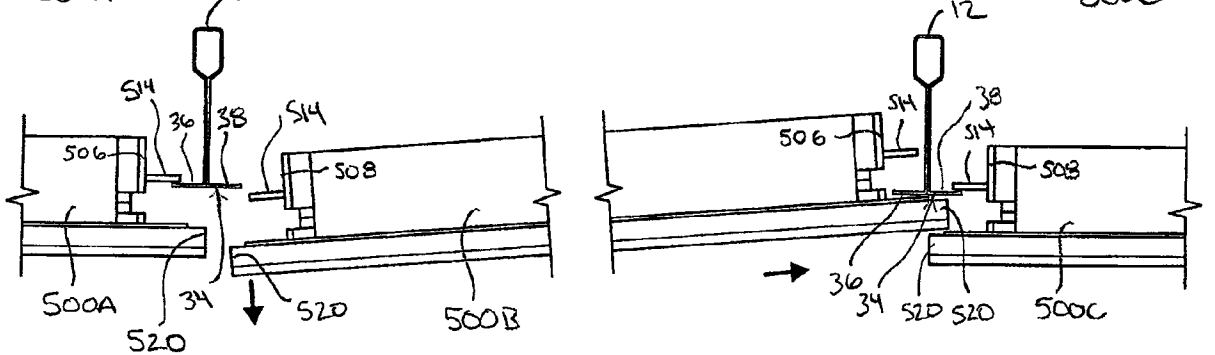
FIG. 32 is a side view of the suspended ceiling panels and grid runners of FIG. 30 showing a second step in the removal of one of the ceiling panels.
Figure 33:
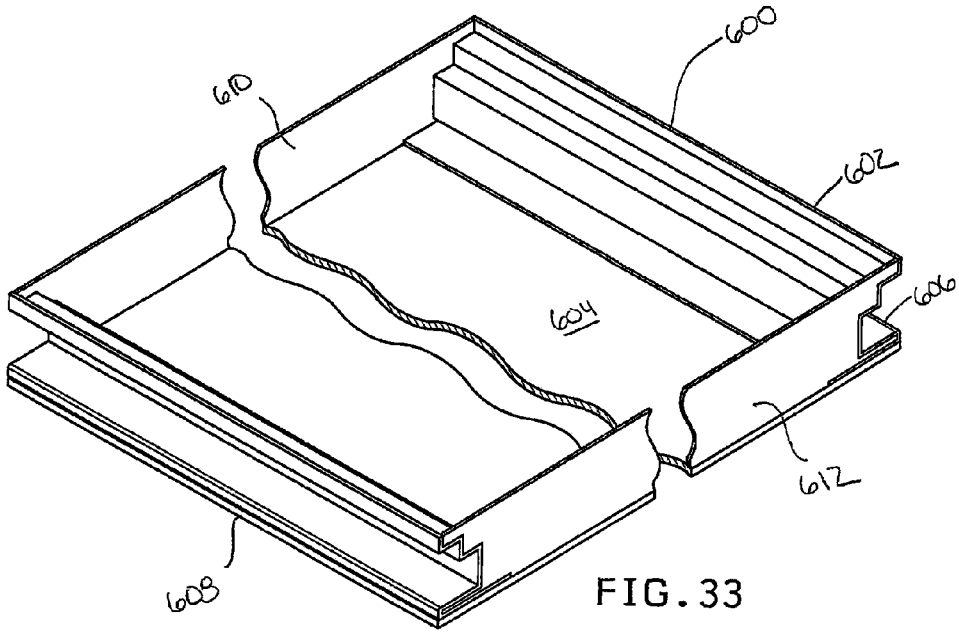
FIG. 33 is a perspective view of a sixth embodiment of a ceiling panel embodying features of the present invention.
Figure 34:
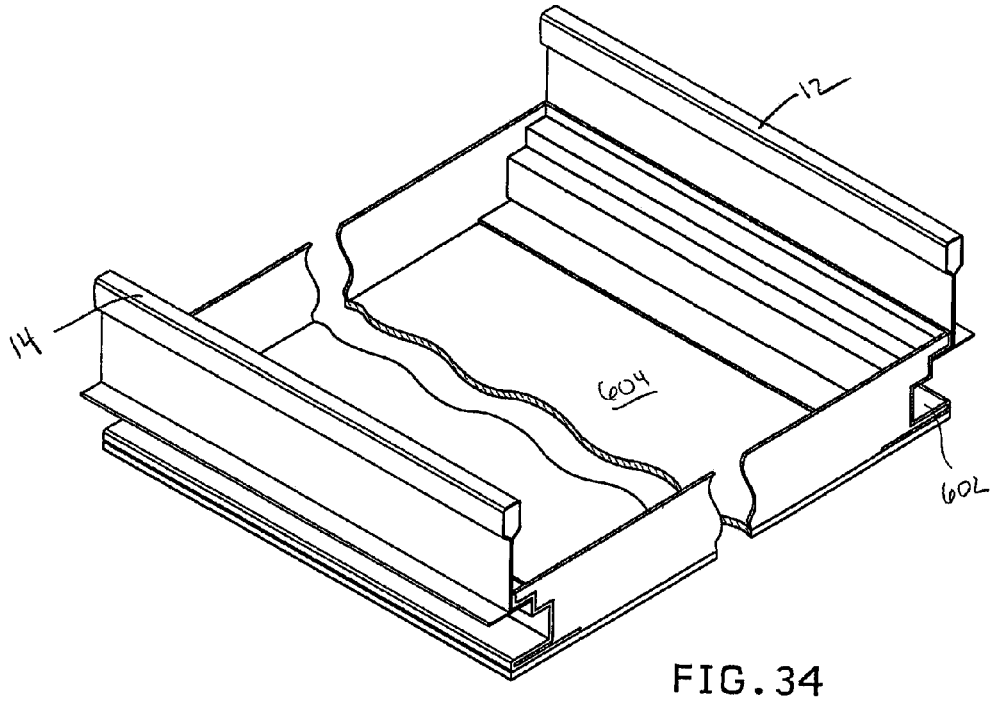
FIG. 34 is a perspective view of the ceiling panel of FIG. 33 as suspended from grid runners.

FIGS. 31-32 illustrate a ceiling panel being removed from a suspended position within the grid 22 using a lift-and-shift motion. Adjacent parallel main tee grid runners 12, 14 are shown with a series of three adjacent ceiling panels 500A, 500B, and 500C. The removal of the ceiling panel 500 will be described, with the installation of the ceiling panel 500 being accomplished by the same series of steps being performed in reverse order and in the reverse directions.

To begin removal, the ceiling panel 500B of this embodiment is lifted upward vertically until the lip 520 of side walls 506, 508 contacts the flange 34. The ceiling panel 500B is then shifted to the right toward ceiling panel 500C (although the removal may also be completed by shifting the ceiling panel 500B to the left toward ceiling panel 500A). When the ceiling panel 500B is shifted to the right, the lip 520 on side wall 506 of ceiling panel 500B is inserted in the space between the flange 34 of main tee grid runner 12 and the lip 520 of ceiling panel 500C. As the ceiling panel 500B is further shifted to the right, the support flange 514 of the opposing side wall 508 of the ceiling panel 500B clears the flange 34 of main tee grid runner 14 and is able to drop down. As the side wall 508 of the ceiling panel 50013 continues to drop, the lip 520 of side wall 506 is removed from the space between the flange 34 and the lip 520 of panel 500C and also is free to drop down such that the panel 500B can be removed.

With reference to FIGS. 33-36, there is illustrated a sixth embodiment of a ceiling panel 600, to be used in the grid structure 22 of FIG. 1. The ceiling panel of this embodiment comprises a frame 602 and a facing material 604 secured across the frame 602. The facing material 604 generally functions to provide an esthetically pleasing and generally monolithic ceiling appearance. The frame 602 provides support structure to which the facing material 604 is secured and also provides the suspension structure for the ceiling panel 600 such that the ceiling panel 600 engages with and is supported by the grid. The frame 602 is preferably formed from a length of roll-formed metal. When assembled, the frame 602 has a generally rectangular configuration, with the facing material 604 extending across the bottom of the frame 602 and secured thereto.

Figure 35:
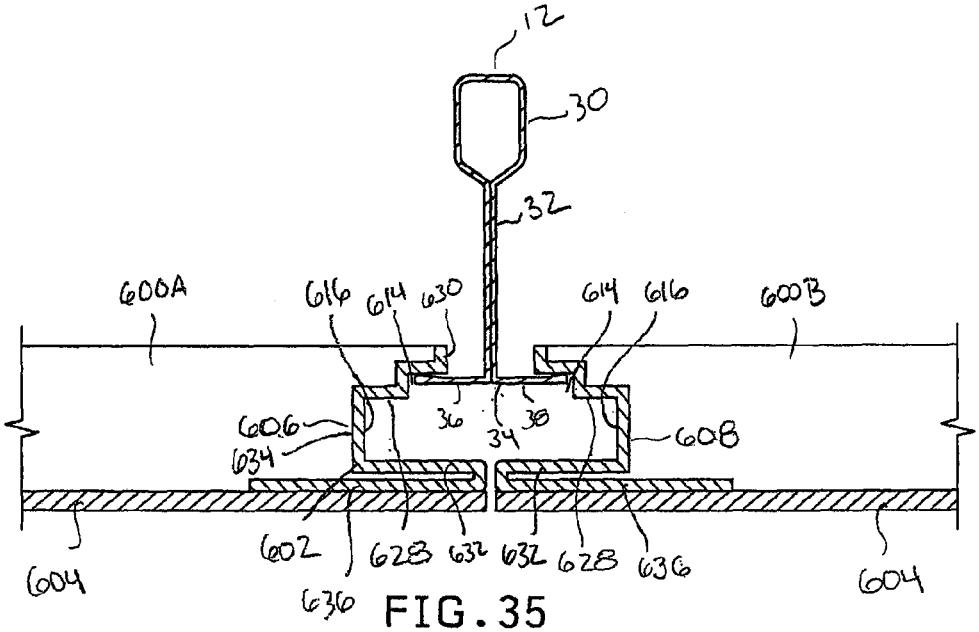
FIG. 35 is a cross-sectional view of the ceiling panel and grid runner of FIG. 34, with an adjacent ceiling panel suspended from the grid runner.
Figure 36:
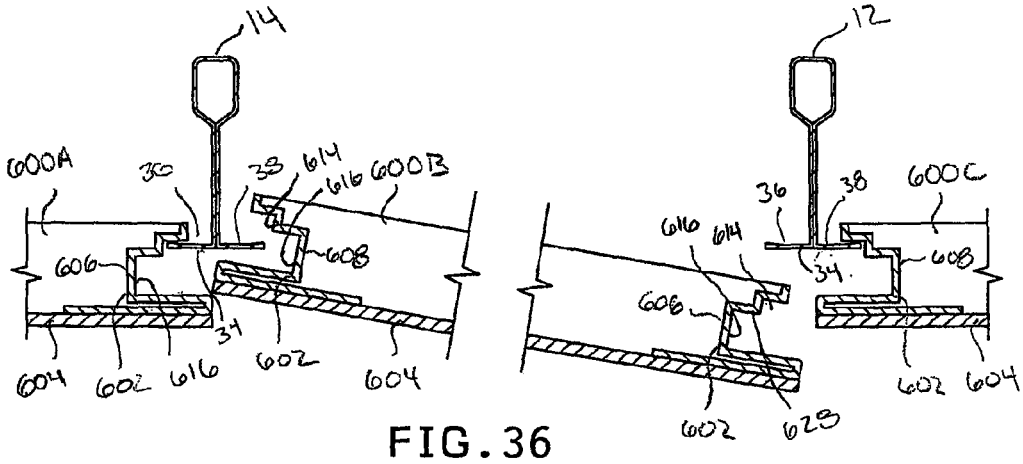
FIG. 36 is a cross-sectional view of a plurality of the suspended ceiling panels and grid runners shown in FIG. 35, showing the installation or removal of one of the ceiling panels.
Figure 37:
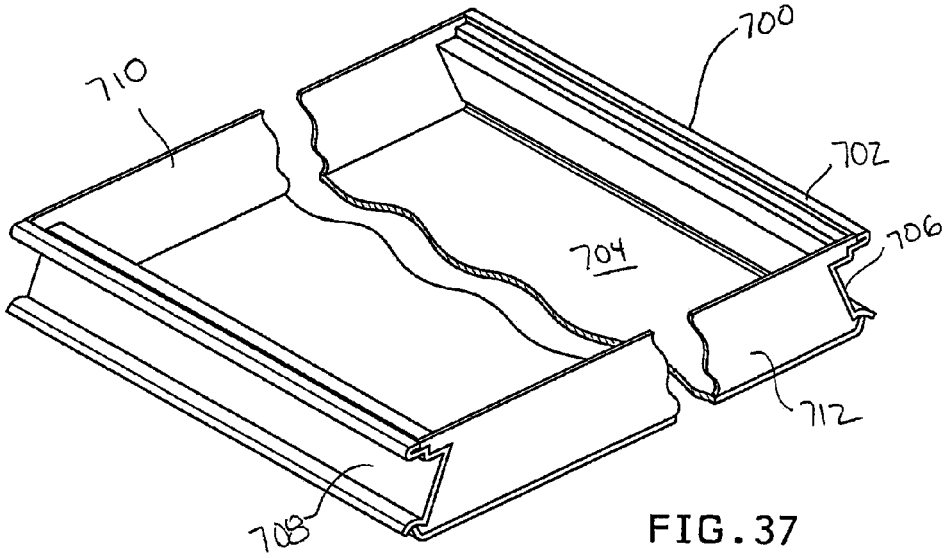
FIG. 37 is a perspective view of a seventh embodiment of a ceiling panel embodying features of the present invention.
Figure 38:
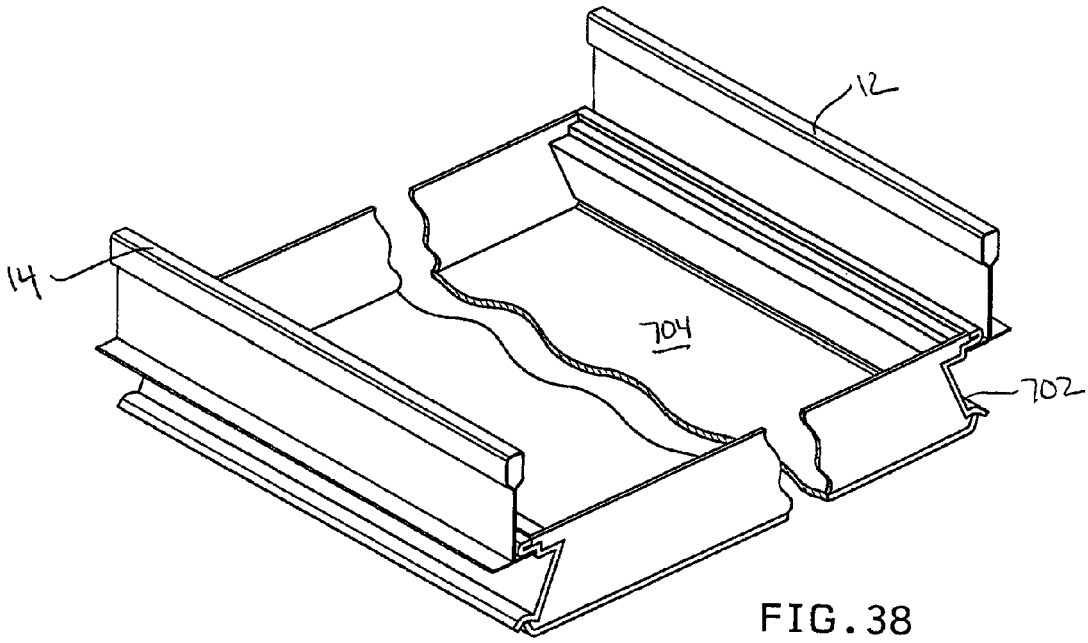
FIG. 38 is a perspective view of the ceiling panel of FIG. 37 as suspended from grid runners.

The frame 602 of this embodiment has a stepped perimeter profile 628 along a first pair of opposing sides 606, 608. A second pair of opposing sides 610, 612 comprise upstanding sidewalls, although other profile options may be used. The stepped profile 628 is comprised of a vertical riser 630 extending to a horizontal support step 614. A positioning step 616 is formed below the support step 614, with the positioning step 616 extending horizontally deeper than the support step 614 to complete the stepped profile 628. The support step 614 generally functions to provide a suspension surface for the ceiling panel 600, with the support step 614 being supported by the flange 34 of the main tee grid runner 12 during suspension of the ceiling panel 600, as shown in FIGS. 35 and 36. The support step 614 also assists in accurately positioning the ceiling panel 600 on the grid flange 34. The positioning step 616 allows for the lift and shift installation and/or removal of the ceiling panel 600 from the grid 22. A horizontal extension wall 632 extends from the back wall 634 of the positioning step 614 to a point beyond the riser 630. The extension wall 632 preferably extends generally to a midpoint of the grid runner 12 web 34 such that the extension wall 632 conceals a side 36 or 38 of the flange 34 during suspension. The extension wall 632 connects to a lower face wall 636. The lower face wall 636 extends below the extension wall 632 to a point beyond the back wall 634 of the positioning step 614. The facing material 604 is secured to the lower face wall 636 using any suitable securing means, such as, for example, by chemically attaching the flap portions using a glue or adhesive or any known mechanical means.

FIGS. 35 and 36 show the installed condition of the ceiling panel 600 of this embodiment. The ceiling panel is supported on opposing sides by the support step 614 hanging on the flange 34 of the main tee grid runners 12, 14. When suspended, the lower face wall 636 of the frame 602 extends under a side 36, 38 of the grid flange 34 to conceal the main tee grid runner 12. The frame 602 is then substantially, if not fully, concealed by the facing material 604 secured thereto. As a result, when viewed from below, the main tee grid runners 12, 14 are at least partially concealed, and preferably fully concealed, by the facing material 604 to provide a monolithic appearance.

FIG. 36 illustrates a ceiling panel 600 being installed and/or removed from a suspended position within the grid 22 using a lift-and-shift motion. Adjacent parallel main tee grid runners 12, 14 are shown with a series of three adjacent ceiling panels 600A, 600B, and 600C. In this illustration, ceiling panel 600B is being removed. As the ceiling panels are symmetrical in that there is a stepped profile 628 along opposing edge regions 606, 608, it is understood that the installation and/or removal may be performed using the stepped profile 628 feature along either side.

To begin removal, the ceiling panel 600B of this embodiment is lifted vertically until the extension wall 632 along sides 606, 608 is generally adjacent the flanges 34 of main tee grid runners 12, 14 and the flanges 34 are generally aligned with the positioning step 616. The ceiling panel is then shifted to the left toward ceiling panel 600A. When the ceiling panel 600B is shifted to the left, the extension wall 632, lower face wall 636, and the facing material 604 secured thereto on side 608 of the ceiling panel 600B is inserted in the space between flange 34 of main tee grid runner 14 and the extension wall 632 of ceiling panel 600C. In addition, side 38 of the main tee grid runner 14 is positioned within the positioning step 616 of side 608 of the ceiling panel 600B. As the ceiling panel 600B is further shifted to the left, the support step 614 of side 606 of the ceiling panel 600B shifts clear of the flange 34 of main tee grid runner 12 and is able to drop down. As the side 608 of the ceiling panel 600B continues to drop, the extension wall 632, lower face wall 636, and the facing material 604 secured thereto on side 608 is removed from the space between the flange 34 of main tee grid runner 14 and the extension wall 632 of ceiling panel 600C and is also free to drop down such that panel 600B can be removed.

With reference to FIGS. 37-40, there is illustrated a seventh embodiment of a ceiling panel 700, to be used in the grid structure 22 of FIG. 1. The ceiling panel of this embodiment comprises a frame 702 and a facing material 704 secured across the frame 702. The facing material 704 generally functions to provide an aesthetically pleasing and generally monolithic ceiling appearance. The frame 702 provides support structure to which the facing material 704 is secured and also provides the suspension structure for the ceiling panel 700 such that the ceiling panel 700 engages with and is supported by the grid. The frame 702 is preferably formed from a length of roll-formed metal. When assembled, the frame 702 has a generally rectangular configuration, with the facing material 704 extended across the bottom of the frame 702 and secured thereto.

Figure 39:
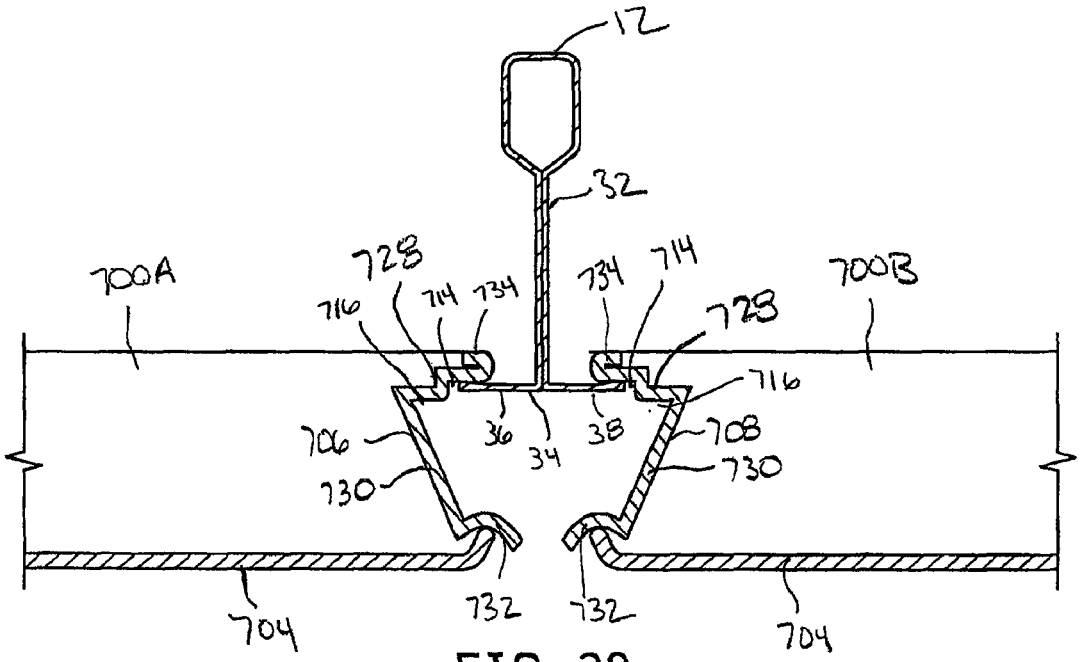
FIG. 39 is a cross-sectional view of the ceiling panel and grid runner of FIG. 38, with an adjacent ceiling panel suspended from the grid runner.
Figure 40:
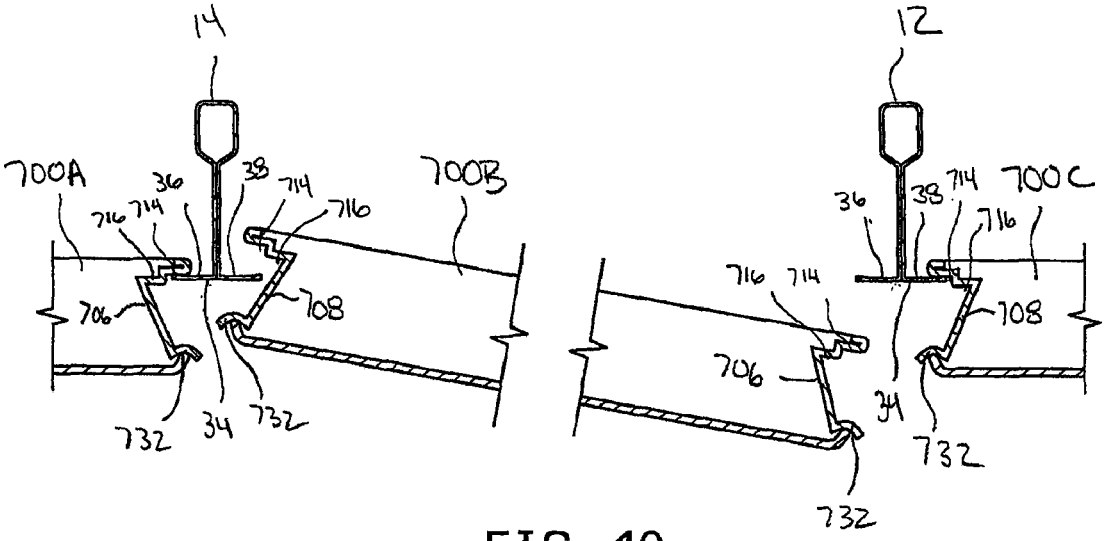
FIG. 40 is a cross-sectional view of a plurality of the suspended ceiling panels and grid runners shown in FIG. 39, showing the installation or removal of one of the ceiling panels.
Figure 41:
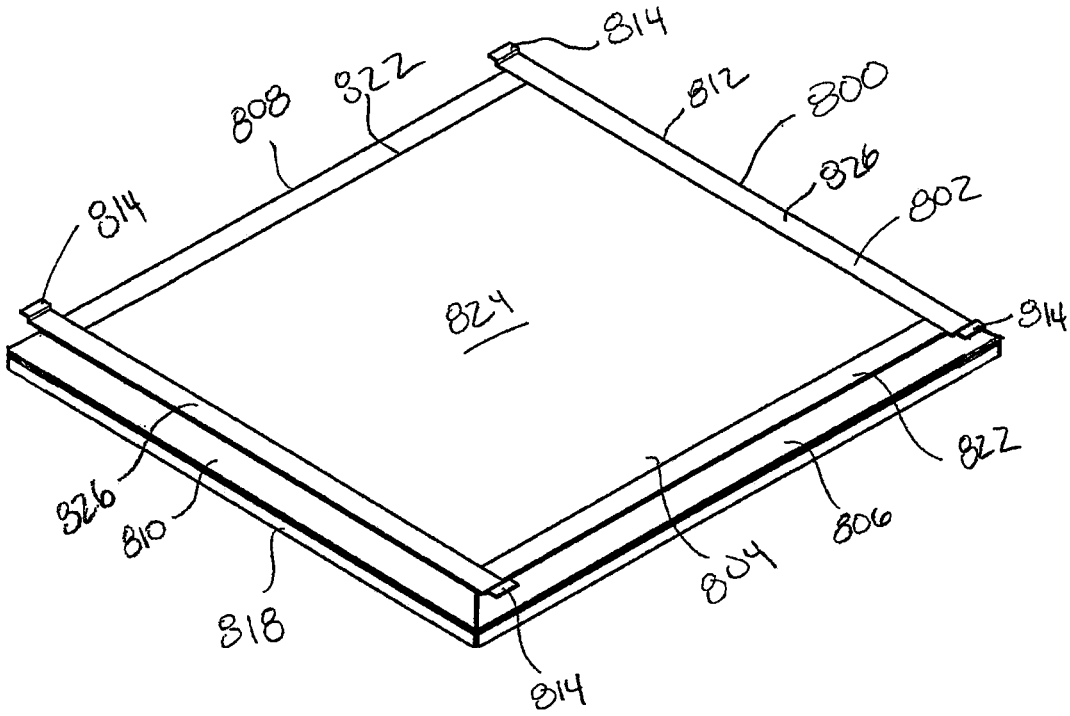
FIG. 41 is a perspective view of an eighth embodiment of a ceiling panel embodying features of the present invention.
Figure 42:
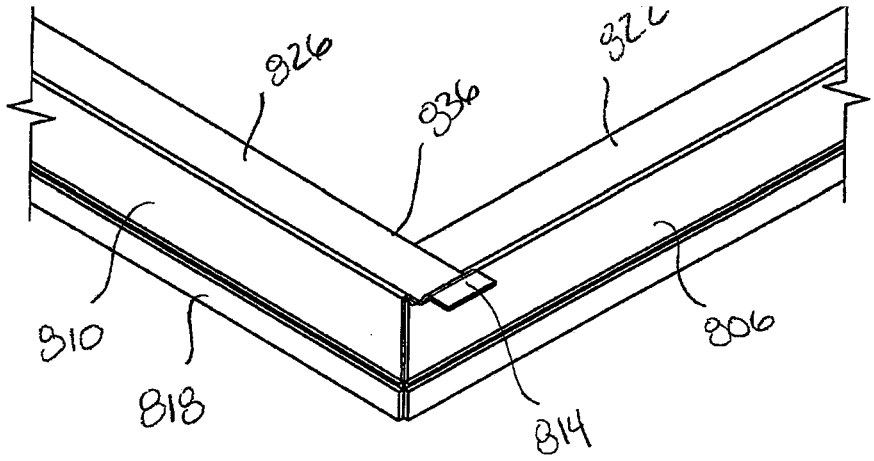
FIG. 42 is a fragmentary perspective view of a corner of the ceiling panel of FIG. 41.

The frame 702 of this embodiment has a stepped upper profile 728 connected to an angled wall 730 along a first pair of opposing sides 706, 708. A second pair of opposing sides 710, 712 comprise upstanding sidewalls, although other profile options may be used. The stepped profile 728 is comprised of a horizontal support step 714 and a positioning step 716 formed below the support step 714, with the positioning step 716 extending horizontally deeper than the support step 714 to complete the stepped profile 728. The support step 714 generally functions to provide a suspension surface for the ceiling panel 700, with the support step 714 being supported by the flange 34 of the main tee grid runner 12 during suspension of the ceiling panel 700, as shown in FIGS. 39 and 40. The support step 714 also assists in accurately positioning the ceiling panel 700 on the grid flange 34. A top facing wall 734 optionally extends over the support step 714 to provide rigidity and support to the support step 714 being suspended from the flange 34. An angled wall 730 extends from the positioning step 716, and angles downwardly toward the center of the flange 34 during suspension. The angled wall 730 has a curved lip 732 at a terminal end thereof. The lip 732 hems over the facing material 704 to catch the facing material 704 and secure the facing material 704 to the frame 702. The stepped profile 728 and angled wall 730 allow for the lift and shift installation and/or removal of the ceiling panel 700 from the grid 22.

FIGS. 39 and 40 show the installed condition of the ceiling panel 700. The ceiling panel 700 is supported on opposing sides 706, 708 by the support step 716 hanging on the flange 34 of the main tee grid runners 12, 14. When suspended, a portion of the angled wall 730 and the curved lip 732 of the frame extend under side 36, 38 of the grid flange 34 to partially conceal the main tee grid runner 12. The frame 702 is then fully concealed by the facing material 704 secured thereto. As a result, when viewed from below, the main tee grid runners 12, 14 are at least partially concealed by the facing material 704.

FIG. 40 illustrates a ceiling panel 700 of this embodiment being installed and/or removed from a suspended position within the grid 22 using a lift-and-shift motion. Adjacent parallel main tee grid runners 12, 14 are shown with a series of three adjacent ceiling panels 700A, 700B, and 700C. In this illustration, ceiling panel 700B is being removed. As the ceiling panels are symmetrical in that there is a stepped profile 728 along both opposing edge regions 706, 708, it is understood that the installation and/or removal may be performed using the stepped profile 728 feature along either side.

To begin removal, the ceiling panel 700B of this embodiment is lifted vertically until the flange 34 of main tee grid runners 12, 14 is aligned with the positioning step 716. The ceiling panel 700B is then shifted to the left toward ceiling panel 700A. When the ceiling panel 700B is shifted to the left, the lip 732 and the facing material 704 secured thereto on side 708 of the ceiling panel 700B is inserted in the space between flange 34 of main tee grid runner 14 and the lip 732 of ceiling panel 700A. In addition side 38 of the main tee grid runner 14 is positioned within the positioning step 716 of side 708 of the ceiling panel 700B. As the ceiling panel 700B is further shifted to the left, the support step 714 of side 706 of the ceiling panel 700B shifts clear of the flange 34 of the main tee grid runner 12 and is able to drop down. As the side 708 of the ceiling panel 700B continues to drop, the lip 732 and the facing material 704 secured thereto on side 708 is removed from the space between the flange 34 of main tee grid runner 14 and the lip 732 of ceiling panel 700C and is also free to drop down such that panel 700B can be removed.

With reference to FIGS. 41-44, there is illustrated an eighth embodiment of a ceiling panel 800 to be used in the grid structure 22 of FIG. 1. The ceiling panel of this embodiment comprises a frame 802 and a facing material 804 secured across the frame 802. The facing material 804 generally functions to provide an aesthetically pleasing and generally monolithic ceiling appearance. The facing material 804 has a center portion 824 having a generally rectangular configuration, with the center portion 824 being sized to generally match the size of the frame 804. In addition, the facing material 804 includes flap portions 818 along each side of the center portion 824, which are secured to the frame 802. The frame 802 provides support structure to which the facing material 804 is secured and also provides the suspension structure for the ceiling panel 800 such that the ceiling panel 800 engages with and is supported by the grid 22. The frame 802 is preferably formed from a length of roll-formed metal. When assembled, the frame 802 has a generally rectangular configuration, with the facing material 804 extended across the bottom of the frame 802 and secured thereto.

The frame 802 of this embodiment has a first pair of opposing angled side walls 806, 808 and a second pair of opposing angled side walls 810, 812. An upstanding lip 820 extends from a terminal end of the angled side walls 806, 808, 810, 812. The flap portions 818 of the facing material 804 are secured to the lip 820 of each angled side 806, 808, 810, 812. Angled side walls 806, 808 connect to top facing wall 822 and angled side walls 810, 812 connect to top facing wall 826. The top facing wall 826 overlays the top facing wall 822 in the corner regions 836 of the frame 802. In addition, top facing wall 826 has a support flange 814 extending from each end thereof over angled side walls 806, 808. The support flange 814 is elevated above the plane of the top facing wall 826 by a riser 816. Although a pair of support flanges 814 are shown extending over each angled side wall 806, 808, it should be noted that there may be any number of support flanges 814 extending over angled side walls 806, 808, with the support flanges 814 positioned anywhere along the length of the angled side walls 806, 808. In addition, the support flanges 814 may be any length.

Figure 43:
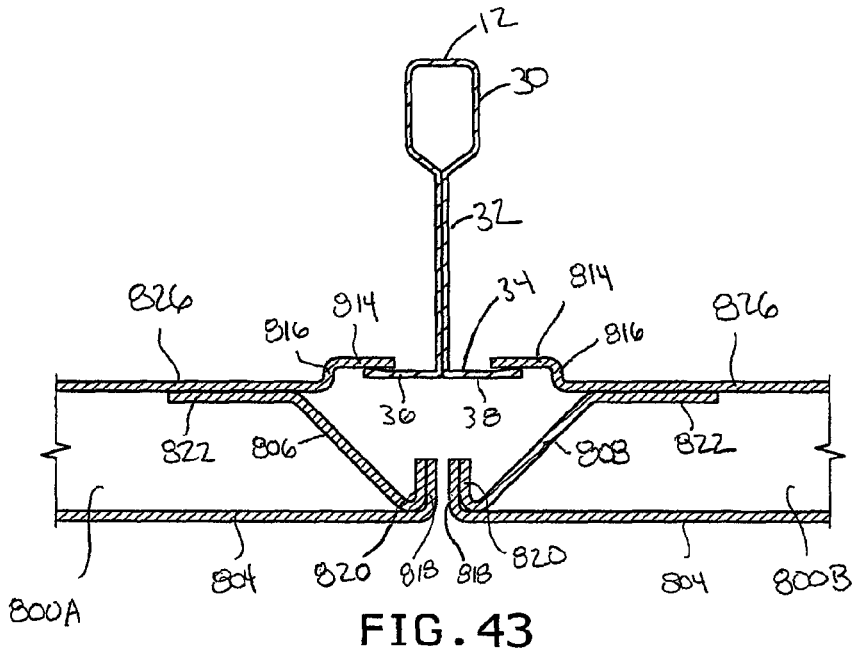
FIG. 43 is a cross-sectional view of the ceiling panel of FIG. 41 as suspended from a grid runner and with an adjacent ceiling panel also suspended from the grid runner.
Figure 44:
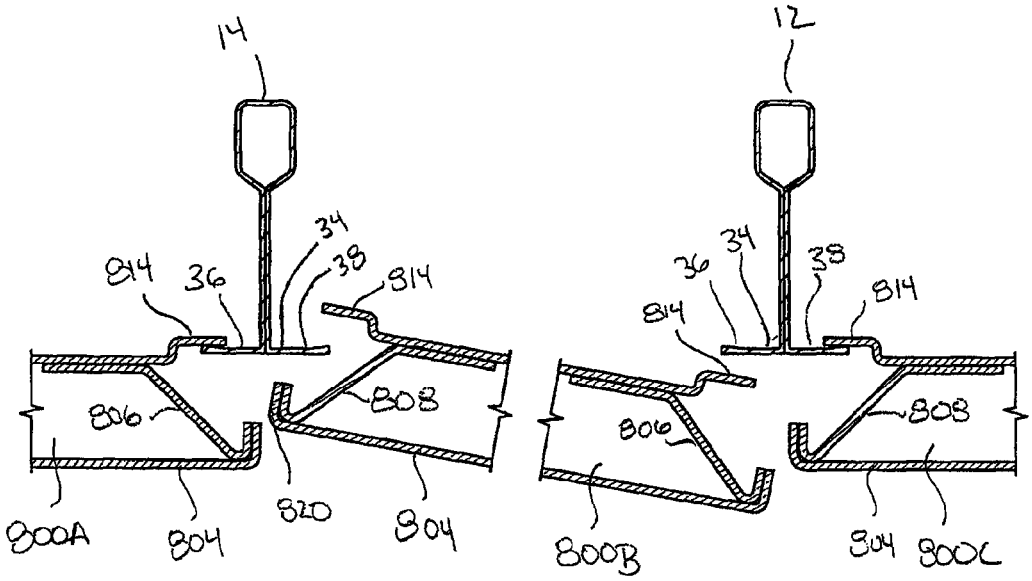
FIG. 44 is a cross-sectional view of a plurality of the suspended ceiling panels and grid runners shown in FIG. 43, showing the installation or removal of one of the ceiling panels.

FIG. 43 shows the installed condition of ceiling panels 800A and 800B of this embodiment. The ceiling panels 800A, 800B are supported by the support flanges 814 hanging on the flange 34 of the main tee grid runner 12. When suspended, the angled walls 806, 808 extend under a side 36, 38 of the flange 34 to at least partially conceal the main tee grid runner 12. The frame 802 is then fully concealed by the facing material 804 being secured thereto. In addition, the flap portion 818 secured to the lip 820 serves to fill the space between the lips 820 of the adjacent ceiling panels 800A and 800B to further conceal the main tee grid runner 12. As a result, when viewed from below, the main tee grid runner 12 is at least partially concealed by the facing material 804 to provide a generally monolithic appearance. In addition, the angled walls 810, 812 conceal the cross tee grid runners in the same manner.

To begin removal, the ceiling panel 800B of this embodiment is lifted vertically until the lip 820 is generally adjacent the flange 34 of main tee grid runners 12, 14 and aligned with the space between the flange 34 and the lip 820 of ceiling panel 800A. The ceiling panel 800B is then shifted to the left toward ceiling panel 800A. When the ceiling panel 800B is shifted to the left, the lip 820 and the facing material 804 secured thereto on side 808 of the ceiling panel 800B is inserted in the space between flange 34 of main tee grid runner 14 and the lip 820 of ceiling panel 800A. As the ceiling panel 800B is further shifted to the left, the support flange 814 adjacent side 808 of the ceiling panel 800B shifts clear of the flange 34 of the main tee grid runner 12 and is able to drop down. As the side 808 of the ceiling panel 800B continues to drop, the lip 820 and the facing material 804 secured thereto on side 808 is removed from the space between the flange 34 of main tee grid runner 14 and the lip 820 of ceiling panel 800C and is also free to drop down such that panel 800B can be removed.

Those skilled in the art will recognize that a wide variety of modifications, alterations, and combinations can be made with respect to the above described embodiments without departing from the spirit and scope of the invention, and that such modifications, alterations, and combinations are to be viewed as being within the ambit of the inventive concept.

We claim:

1. A ceiling panel comprising a base having an upper face and a lower face, and a facing material secured across the lower face of the base, said base and facing material being rectangular in shape, the facing material functioning to provide the visible appearance side of the panel when the panel is suspended on a ceiling grid, the base having a stepped perimeter profile along two opposing perimeter edge regions, each edge region having a horizontal support kerf generally vertically midway in the edge region and a positioning kerf below the support kerf, the positioning kerf extending horizontally deeper than the support kerf and having an upper surface and a lower surface, the support kerf providing a suspension surface for the panel capable of being supported on a flange of a grid tee and assisting in horizontally positioning the panel on the grid flange, the positioning kerf allowing lift and shift installation and/or removal of the panel from the grid, the height of the positioning kerf being greater than the thickness of the facing material to provide for sufficient clearance for the installation and removal of the panel, the facing material being secured to the lower face of the base and being cantilevered beyond each of outermost edges of four sides of the base, whereby the facing material forms the lower surface of the positioning kerf.

* * * * *